US006183946B1

(12) United States Patent
Ochiai

(10) Patent No.: US 6,183,946 B1
(45) Date of Patent: Feb. 6, 2001

(54) SILVER HALIDE EMULSION, PRODUCTION PROCESS OF SILVER HALIDE EMULSION, SILVER HALIDE COLOR PHOTOGRAPHIC LIGHT-SENSITIVE MATERIAL AND IMAGE FORMATION METHOD

(75) Inventor: Yoshiro Ochiai, Kanagawa (JP)

(73) Assignee: Fuji Photo Film Co., Ltd., Minami-Ashigara (JP)

( * ) Notice: Under 35 U.S.C. 154(b), the term of this patent shall be extended for 0 days.

(21) Appl. No.: 09/159,545

(22) Filed: Sep. 24, 1998

(30) Foreign Application Priority Data

Sep. 30, 1997 (JP) ..... 9-282823

(51) Int. Cl.[7] ..... G03C 1/08
(52) U.S. Cl. ..... 430/567; 430/569; 430/605
(58) Field of Search ..... 430/567, 569, 430/605

(56) References Cited

U.S. PATENT DOCUMENTS 5,284,743 * 2/1994 Ohshima et al. ..... 430/567
5,393,653 2/1995 Kawai ..... 430/569
5,462,849 * 10/1995 Kuromoto et al. ..... 430/567
5,916,742 * 6/1999 Ikari et al. ..... 430/567

FOREIGN PATENT DOCUMENTS 273429 7/1988 (EP) ..... G03C/1/02
573854 12/1993 (EP) ..... G03C/7/30
58-95736 6/1983 (JP) ..... G03C/1/035
6-95280 4/1994 (JP) ..... G03C/1/02

* cited by examiner

*Primary Examiner*—Mark F. Huff
*Assistant Examiner*—Amanda C. Walke
(74) *Attorney, Agent, or Firm*—Burns, Doane, Swecker & Mathis, LLP

(57) ABSTRACT

A silver halide emulsion is disclosed, which is a silver chlorobromide or silver chloroiodobromide emulsion having a silver chloride content of 90 mol % or more, wherein the silver halide grain in said emulsion has, in the vicinity of the grain surface, a silver bromide-rich phase containing an iridium compound and, the silver bromide-rich phase comprises an inner part region and an outer side part region, wherein the inner side part region has a higher iridium compound density than the outer side part region has.

23 Claims, No Drawings

SILVER HALIDE EMULSION, PRODUCTION PROCESS OF SILVER HALIDE EMULSION, SILVER HALIDE COLOR PHOTOGRAPHIC LIGHT-SENSITIVE MATERIAL AND IMAGE FORMATION METHOD

FIELD OF THE INVENTION

The present invention relates to a silver halide emulsion having excellent high-illuminance reciprocity law failure characteristics, reduced in change of sensitivity and change of gradation due to changing in the time after exposure until processing and small in the reduction of sensitivity on exposure at a high humidity, a production process thereof and a silver halide color photographic light-sensitive material using the same.

BACKGROUND OF THE INVENTION

In recent years, requirements for the capabilities of a color printing paper, such as high sensitivity, processing stability, high-quality image and rapid processability in the development processing step are increasing. On the other hand, as a result of recent popularization of laser scanning exposure apparatuses, suitability for short-time and high-illuminance exposure is one of the important capabilities. The laser scanning exposure is advantageous in that high-speed exposure is attained and the resolution is improved. However, for applying this to a color printing paper, suitability for unusually very short-time (specifically, $10^{-6}$ second) and high-illuminance exposure is required.

In order to improve the reciprocity law failure of the silver halide emulsion at such high-illuminance exposure, a method of doping a metal compound represented by iridium to the base grain is well known in the art.

The improvement of the reciprocity law failure of the silver halide emulsion by iridium is described, for example, in B. H. Carroll, Iridium Sensitization: A Literature Review of *Photographic Science and Engineering,* Vol. 24, No. 6 (1980), and R. S. Eachus, *The Mechanism of Ir*3+ *Sensitization* (*International Meeting* 1982 *of Photographic Science).*

On the other hand, it is also known that the silver halide emulsion having added thereto iridium has a very undesired characteristic such that the photographic capabilities (for example, sensitivity, gradation) change in the time passing after the exposure until the processing. This characteristic is described in H. Zwicky, On the Mechanism of the Sensitivity Increase With Iridium in Silver Halide Emulsions of *The Journal of Photographic Science,* Vol. 33, pp. 201–203 (1985). According to the methods hitherto proposed, the high-illuminance reciprocity law failure is surely improved but the sensitivity very greatly changes due to changing in the time after exposure until processing and the practical use is not expected at all.

A silver halide emulsion having a high silver chloride content has a purpose of rapid processing in the color development but is deficient in that high-sensitivity high-contrast gradation cannot be obtained by usual chemical sensitization. A large number of attempts have been made to achieve high sensitivity of a high silver chloride emulsion. Among those, a technique of forming a silver bromide-rich phase in the vicinity of the grain apex of a silver halide host grain to thereby achieve high sensitivity is disclosed in JP-A-64-26837 (the term "JP-A" as used herein means an "unexamined published Japanese patent application"). Further, JP-A-5-61136 discloses a technique of forming a silver bromide-rich phase in the vicinity of the grain apex of a silver halide host grain through multiple stages. According to these techniques, however, the high-illuminance reciprocity law failure is not improved. U.S. Pat. Nos. 5,284,745, 5,391,471, 5,415,991, 5,043,256 and 5,627,020 disclose a method of doping a metal compound represented by Ir to the inside of a silver bromide-rich phase of a high silver chloride base grain. Further, European Patent Publication 0568091A, U.S. Pat. No. 5,356,770 and JP-A-6-35147 disclose a method of adding a bromide to a high silver chloride grain simultaneously with or after the addition of iridium. According to these methods, the change of sensitivity due to changing in the time after exposure until processing is suppressed and the high-illuminance reciprocity law failure is improved, however, the effect is still not sufficient in the case of a high-illuminance exposure for a very short time, such as laser scanning exposure. In addition, reduction in the sensitivity occurred on exposure at a high humidity is not prevented.

SUMMARY OF THE INVENTION

Accordingly, an object of the present invention is to provide a silver halide emulsion having excellent reciprocity law failure characteristics on short-time high-illuminance exposure, reduced in change of sensitivity due to changing in the time after exposure until processing and small in the reduction of sensitivity on exposure at a high humidity.

Another object of the present invention is to provide a process for producing the silver halide emulsion.

A still another object of the present invention is to provide a silver halide color photographic light-sensitive material using the silver halide emulsion.

A further object of the present invention is to provide a method for forming an image using the silver halide emulsion.

As a result of extensive investigations, the present inventors have found that the above-described objects can be effectively achieved by the following methods (1) to (7).

(1) A silver halide emulsion which is a silver chlorobromide or silver chloroiodobromide emulsion having a silver chloride content of 90 mol % or more, wherein the silver halide grain in said emulsion has a silver bromide-rich phase containing an iridium compound in the vicinity of the grain surface and the silver bromide-rich phase comprises an inner side part region and an outer side part region, wherein the inner side part region has a higher iridium compound density than the outer side part region has.

(2) The silver halide emulsion as described in (1), wherein the silver halide grain is a cubic or tetradecahedral grain.

(3) The silver halide emulsion as described in (1), wherein 50% or more of the entire projected area of all grains in the silver halide emulsion is occupied by tabular grains having {100} faces as major faces and having an average aspect ratio of 2 or more or tabular grains having {111} faces as major faces and having an average aspect ratio of 2 or more.

(4) A process for producing a silver halide emulsion, comprising forming a silver bromide-rich phase containing an iridium compound in the vicinity of the grain surface of a silver halide grain in a silver chlorobromide or silver chloroiodobromide emulsion having a silver chloride content of 90 mol % or more, wherein the formation process for forming the silver bromide-rich phase comprises at least two stages and the molar amount of the iridium compound added in one formation process based on the silver added is higher than the molar amount of the iridium compound added in any one of the formation processes subsequent thereto based on the silver added.

(5) The process for producing a silver halide emulsion as described in (4), wherein the silver bromide-rich phase is formed by adding at least twice a silver bromide fine grain emulsion or silver chlorobromide fine grain emulsion having a grain size smaller than that of a silver halide emulsion comprising a silver chlorobromide or silver chloroiodobromide host grains.

(6) A silver halide color photographic light-sensitive material comprising a support having thereon at least one blue-sensitive silver halide emulsion layer, at least one green-sensitive silver halide emulsion layer and at least one red-sensitive silver halide emulsion layer, wherein at least one of said blue-sensitive silver halide emulsion layer, green-sensitive silver halide emulsion layer and red-sensitive silver halide emulsion layer contains a silver chlorobromide or silver chloroiodobromide emulsion having a silver chloride content of 90 mol % or more, wherein the silver halide grain in said emulsion has a silver bromide-rich phase containing an iridium compound in the vicinity of the grain surface and the silver bromide-rich phase comprises an inner side part region and an outer side part region, wherein the inner side part region has a higher iridium compound density than the outer side part region has.

(7) A method for forming an image, comprising exposing by scanning the silver halide color photographic light-sensitive material described in (6) with a laser beam modulated based on the image information for an exposure time of less than $10^{-4}$ second per one pixel.

DETAILED DESCRIPTION OF THE INVENTION

The present invention is described in detail below.

The host silver halide grain for use in the preparation of the emulsion of the present invention is preferably a cubic or tetradecahedral crystal grain having substantially {100} faces (the grain may have rounded corners and may have a higher order face). Further, 50% or more of the entire projected area are preferably occupied by tabular crystal grains comprising a {100} face or {111} face and having an aspect ratio of 2 or more. The aspect ratio is a value obtained by dividing the diameter of a circle corresponding to the projected area of a grain by the thickness of the grain. As the aspect ratio is larger, the grain is smaller in the thickness and flatter. In the present invention, the tabular grain means a grain having an aspect ratio of 1.2 or more and the average aspect ratio means an average of the aspect ratios of all tabular grains in the emulsion. In the present invention, a cubic tabular grain or a tabular grain having a {100} face as the major face is preferably used. The {100} tabular grain is more preferably a tabular grain having an adjacent major face edge length ratio of 10 or less. The adjacent major face edge length ratio as used herein means a value obtained by dividing the longer side out of two sides adjacent to each other by the shorter side. As the adjacent major face edge length ratio is closer to 1, the major face approximates to a square.

The tabular grain containing silver chloride in a high concentration includes a grain having {100} major faces and a grain having {111} major faces.

The tabular silver halide emulsion grain having {100} major faces is formed by the method of adding an aqueous silver salt solution and an aqueous halide salt solution to a dispersion medium such as an aqueous gelatin solution while stirring and mixing the resulting solution. At this time, silver iodide is allowed to be present in JP-A-6-301129 and JP-A-6-347929 or silver bromide is allowed to be present in JP-A-9-34045 to cause distortion in the nucleus due to the difference in the crystal lattice from silver chloride, thereby introducing screw dislocations. When screw dislocations are introduced, the formation of a dimensional nucleus on the face is not the rate determination any more and crystallization on this face proceeds. By introducing screw dislocations into two orthogonal {100} faces, a tabular grain is formed. Also, a method of forming a {100} tabular grain by adding a {100} face formation accelerator is disclosed in JP-A-6-347928 where an imidazole or a 3,5-diaminotriazole is used or in JP-A-8-339044 where a polyvinyl alcohol is used.

A tabular silver halide emulsion grain having {111} major faces is formed by the method of forming the grain in the presence of a crystal habit controlling agent disclosed, for example, in U.S. Pat. Nos. 4,400,463, 5,185,239 and 5,176,991, JP-A-63-213836 and U.S. Pat. No. 5,176,992 where aminoazaindene, triaminopyrimdine, hydroxyaminoazine, thiourea and xanthonoid are used, respectively.

In the case of a silver chloroiodobromide crystal having a silver chloride content of 90 mol % or more, the crystal preferably has a silver iodide content of 2 mol % or less and a silver chloride content of 95 mol % or more, more preferably having a silver iodide content of 1 mol % or less and a silver chloride content of 99 mol % or more.

The silver halide grain preferably has an average grain size of from 0.2 to 2 $\mu$m. The distribution state in higher monodispersion is preferred. The monodisperse emulsion means an emulsion having a coefficient of variation (S/average r) regarding the grain size of silver halide grains, of 0.25 or less, preferably 0.15 or less. The average r is an average grain size and S is a standard deviation regarding the grain size. In other words, assuming that the grain size of individual emulsion grains is ri and the number thereof is ni, the average grain size r is defined by the formula:

$$r = \frac{\sum ni \cdot ri}{\sum ni}$$

and the standard deviation S is defined by the formula:

$$s = \sqrt{\frac{\sum (\bar{r} - ri)^2 \cdot ni}{\sum ni}}$$

The term "individual grain size" as used in the present invention means a diameter of a projected area corresponding to the projected area obtained by microphotographing (usually electron microphotographing) a silver halide emulsion by the method well known in the art as described in T. H. James et al, *The Theory of the Photographic Process,* 3rd. ed., pp. 36–43, Macmillan (1966). The projected area corresponding diameter of a silver halide grain used here is defined as a diameter of a circle having an area equal to the projected area of a silver halide grain as described in the above-described publication.

The silver bromide-rich phase of the present invention can be formed by the following methods:

(1) a method of adding and mixing a water-soluble compound such as an aqueous potassium bromide solution;

(2) a method of adding and mixing silver halide grains having an average grain size smaller than that of silver halide host grains and having a high silver bromide content (mol %); and (3) a method of adding and mixing bromine and/or a bromide ion precursor represented by formula (S).

For supplying the bromine and/or bromide ion, the method (1) or (2) may be used in combination. The silver bromide-rich phase preferably has a silver bromide content of from 10 to 70 mol %, more preferably from 20 to 60 mol %.

(S)

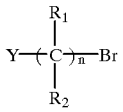

(wherein Y represents an organic group having a Hammett's σp value greater than 0; $R_1$ and $R_2$ each represents a hydrogen atom, a substituted or unsubstituted alkyl group, a substituted or unsubstituted alkenyl group, a substituted or unsubstituted aralkyl group, a substituted or unsubstituted aryl group or a group represented by Y; Y and $R_1$ may ring-close to form a heterocyclic ring; and n represents an integer of from 1 to 3).

Formula (S) is described in greater detail below. Y represents an organic group having a Hammett's σp value greater than 0. The Hammett's σp values are described in Yakubutsu no Kozo Kassei Sokan (Interrelation in *Structural Activity of Chemicals*), p. 96, Nan'kodo (1979), and the substituent may be selected based on the table set forth therein. Y is preferably a halogen atom (e.g., bromine, chlorine, fluorine), a trifluoromethyl group, a cyano group, a formyl group, a carboxylic acid group, a sulfonic acid group, a carbamoyl group (e.g., unsubstituted carbamoyl, diethylcarbamoyl), an acyl group (e.g., acetyl, benzoyl), an oxycarbonyl group (e.g., methoxycarbonyl, ethoxycarbonyl), a sulfonyl group (e.g., methanesulfonyl, benzenesulfonyl), a sulfonyloxy group (e.g., methanesulfonyloxy), a carbonyloxy group (e.g., acetoxy), a sulfamoyl group (e.g., unsubstituted sulfamoyl, dimethylsulfamoyl) or a heterocyclic group (e.g., 2-thienyl, 2-benzoxazolyl, 2-benzothiazolyl, 1-methyl-2-benzimidazolyl, 1-tetrazolyl, 2-quinolyl). $R_1$ and $R_2$ each represents a hydrogen atom, a substituted or unsubstituted alkyl group (e.g., methyl, ethyl, n-propyl, hydroxyethyl), a substituted or unsubstituted alkenyl group (e.g., vinyl, allyl), a substituted or unsubstituted aralkyl group (e.g., benzyl), a substituted or unsubstituted aryl group (e.g., phenyl, p-tolyl) or a group represented by Y. Y and $R_1$ may ring-close to form a heterocyclic ring (e.g., imidazolyl, pyridyl, thienyl, quinolyl, tetrazolyl). In formula (S), preferably Y represents a cyano group, a carboxylic acid group, a carbamoyl group, an acyl group, a sulfonyl group, an oxycarbonyl group, a sulfamoyl group or a heterocyclic group, $R_1$ and $R_2$ each represents a hydrogen atom or Y, and n represents an integer of 1 or 2. Specific examples of the compound represented by formula (S) of the present invention are set forth below, however, the compound of the present invention is by no means limited thereto.

(S-1)

$BrCH_2COOH$ (S-2)

$Br(CH_2)_2COOH$ (S-3)

$Br(CH_2)_3COOH$

-continued (S-4)

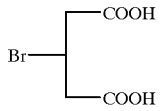

(S-5)

$BrCH_2CN$ (S-6)

$Br(CH_2)_2CONH_2$ (S-7)

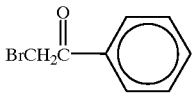

(S-8)

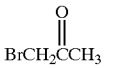

(S-9)

$Br(CH_2)_2SO_2CH_3$ (S-10)

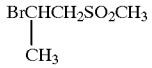

(S-11)

$BrCH_2COOCH_3$ (S-12)

$BrCH_2CH_2SO_2NH_3$ (S-13)

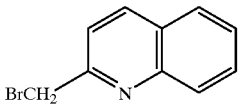

(S-14)

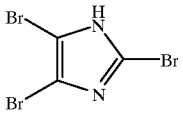

(S-15)

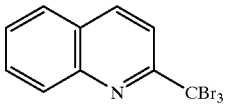

(S-16)

$BrCH_2CH_2SO_3Na$

The compound represented by formula (S) is easily available on the market as a reagent. The compound represented by formula (S) is preferably added in an amount of from 0.1 to 5 mol %, more preferably from 0.2 to 3 mol %, based on the entire silver halide.

The silver bromide-rich phase can also be formed through the following process. Bromide ions or silver bromide fine particles are supplied to the above-descried host silver halide grains to precipitate a new silver halide phase more rich in silver bromide on the surface of the host silver halide grain. The process by the bromide ion proceeds by the exchange reaction with a halogen ion on the surface of the host silver halide grain, so-called "halogen conversion" process. Another process by the silver halide fine grain proceeds by the reaction called "recrystallization" of forming a crystal having a more stable composition between the host silver halide grain and the silver bromide fine grain, and belongs to a category different from the conversion reaction. In this recrystallization reaction, the driving force of the reaction is the increase in the entropy, and the reaction is quite different from the Ostwald ripening. This is described, for example, in H. C. Yutzy, *Journal of American Chemical Society,* p. 59916 (1937). Although these two kinds of reactions are quite different from each other, the vicinity of the host grain apex is surprisingly selected as the new phase more rich in silver bromide in either reaction but this is a well known phenomenon.

The silver halide grain of the present invention has a silver bromide-rich phase containing an iridium compound in the vicinity of the grain surface. The vicinity of the surface is any one of the grain surface layer part, the grain edge part and the grain corner part. The iridium compound is a compound containing ion or complex ion of iridium as a metal belonging to Group VIII of the Periodic Table. The amount of the iridium compound used is preferably from $10^{-3}$ to $10^{-9}$ mol, more preferably from $10^{-4}$ to $10^{-7}$ mol, per mol of the entire silver of the grain. The iridium compound is described in detail below, but the present invention is by no means limited thereto.

formed immediately before the chemical ripening step, during the chemical ripening or after the chemical ripening, more preferably during the chemical ripening, of the above-described steps.

In the formation of the silver bromide-rich phase of the present invention, it is effective to use a compound (CR compound) which suppresses or inhibits the initiation of halogen conversion or recrystallization. The CR compound in general is a substance which selectively adsorbs to a specific crystal face and thereby functions to retard or thoroughly inhibit the initiation of halogen conversion or recrystallization as compared with the case when the compound is not adsorbed. In the present invention, the compounds represented by formulae (I), (II) and (III) are particularly preferred. In addition, a cyanine dye, a merocyanine dye, a mercaptoazole and a nucleic acid decomposition product (e.g., deoxyribonucleic acid, product in the way of decomposition of ribonucleic acid, adenine, guanine, uracil, cytocil, thymine) may also be used.

(I)

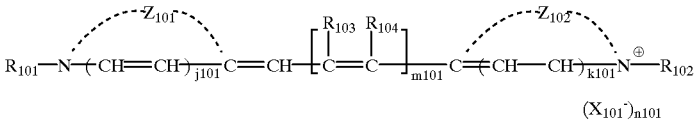

The iridium compound is a trivalent or tetravalent salt or complex salt and a complex salt is preferred. Preferred examples thereof include complex salts having a halogen, an amine or an oxalic acid as a ligand (e.g., iridium(III) chloride, iridium(III) bromide, iridium(IV) chloride, sodium hexachloroiridate(III), potassium hexachloroiridate(IV), hexaammineiridium(IV) salt, trioxalatoirridium(III) salt, trioxalatoiridium(IV) salt).

The iridium compound is present in the inner side part of the silver bromide-rich phase formed and the iridium compound density is partially higher in the inner side part of the silver bromide-rich phase than the iridium compound density in the outer side part. The term "outer side part" as used herein means the area in the depth of 6 Å or more from the surface of the silver bromide-rich phase and in terms of the volume, the area occupying from 1 to 99%, preferably from 30 to 95%, more preferably from 50 to 90% of the volume of the silver bromide-rich phase. The "inner side part" means the inner area more than the outer side part defined above. With respect to the iridium compound density in the silver bromide-rich phase, the density in the inner side part is preferably as higher as possible than the density in the outer side part. The iridium compound density in the inner side part is preferably 3 times or more, more preferably 10 times or more, the iridium compound density in the outer side part, and the case when the iridium compound is absent in the outer side part and present only in the inner side part is most preferred. The iridium compound is preferably present only in the silver bromide-rich phase but may be present in the host silver halide grain.

The preparation process of the silver halide emulsion of the present invention comprises, as well known in general, a step of forming silver halide grains by the reaction between a water-soluble silver and a water-soluble halide, a desilvering step and a chemical ripening step. The silver bromide-rich phase of the present invention is preferably In formula (I), $Z_{101}$ and $Z_{102}$ each represents an atomic group necessary for forming a nitrogen-containing heterocyclic nucleus. The nitrogen-containing heterocyclic nucleus is preferably a 5- or 6-membered ring nucleus containing a nitrogen atom and in addition, a sulfur atom, an oxygen atom, a selenium atom or a tellurium atom as the hetero atoms. The ring may be further bonded with a condensed ring or further bonded with a substituent. Specific examples of the nitrogen-containing heterocyclic nucleus include a thiazole nucleus, a benzothiazole nucleus, a naphthothiazole nucleus, a selenazole nucleus, a benzoselenazole nucleus, a naphthoselenazole nucleus, an oxazole nucleus, a benzoxazole nucleus, a napthoxazole nucleus, an imidazole nucleus, a benzimidazole nucleus, a naphthoimidazole nucleus, a 4-quinoline nucleus, a pyrroline nucleus, a pyridine nucleus, a tetrazole nucleus, an indolenine nucleus, a benzindolenine nucleus, an indole nucleus, a tetrazole nucleus, a benzotellurazole nucleus and a naphtotetrazole nucleus. $R_{101}$ and $R_{102}$ each represents an alkyl group, an alkenyl group, an alkynyl group or an aralkyl group. These groups and the groups described below each include the substitution product thereof. For example, the alkyl group includes an unsubstituted alkyl group and a substituted alkyl group, and these groups each may be linear, branched or cyclic. The alkyl group preferably has from 1 to 8 carbon atoms.

Specific examples of the substituent of the substituted alkyl group include a halogen atom (e.g., fluorine, chlorine, bromine, iodine), a cyano group, an alkoxy group, a substituted or unsubstituted amino group, a carboxylic acid group, a sulfonic acid group and a hydroxyl group. One or a plurality of these substituents may be bonded. Specific examples of the alkenyl group include a vinyl methyl group. Specific examples of the aralkyl group include a benzyl group and a phenethyl group. $m_{101}$ represents 0 or a positive number of 1, 2 or 3. When $m_{101}$ is 1, $R_{103}$ represents a hydrogen atom, a lower alkyl group, an aralkyl group or an aryl group. Specific examples of the aryl group include a substituted or unsubstituted phenyl group. $R_{104}$ represents a hydrogen atom. When $m_{101}$ is 2 or 3, $R_{103}$ represents a hydrogen atom and $R_{104}$ represents a hydrogen atom, a lower alkyl group or an aralkyl group or may be combined with $R_{102}$ to form a 5- or 6-membered ring. When $m_{101}$ represents 2 or 3 and $R_{104}$ represents a hydrogen atom, $R_{103}$ may be combined with another $R_{103}$ to form a hydrocarbon ring or a heterocyclic ring. The ring formed is preferably a 5- or 6-membered ring. $j_{101}$ and $k_{101}$ each represents 0 or 1, $X^-_{101}$ represents an acid anion and $n_{101}$ represents 0 or 1.

render the entire surface of the host grain to be a homogeneous new phase, and accelerates the formation and maintenance of a "new phase more rich in silver bromide" epitaxially grown limitedly to the vicinity of the host grain apex. A method of mixing and ripening high silver bromide fine grains and host grains is advantageous in that the reaction proceeds highly uniformly and is easy to control. Further, this method is preferred because the silver bromide content of the new phase can be controlled over a wide range by the conditions such as silver bromide content or grain size of the high silver bromide fine grain used in the mixing and ripening, or pAg at the time of recrystallization reaction. In (II)

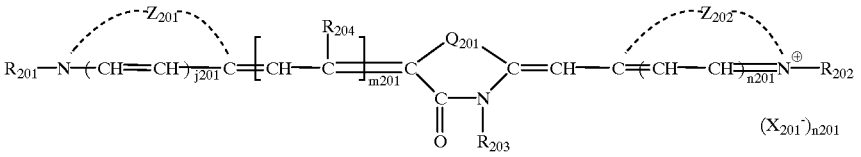

In formula (II), $Z_{201}$ and $Z_{202}$ have the same meanings as $Z_{101}$ and $Z_{102}$ described above, respectively. $R_{201}$ and $R_{202}$ have the same meanings as $R_{101}$ and $R_{102}$ described above, respectively, and $R_{203}$ represents an alkyl group, an alkenyl group, an alkynyl group or an aryl group (e.g., substituted or unsubstituted phenyl). $m_{201}$ represents 0, 1 or 2. $R_{204}$ represents a hydrogen atom, a lower alkyl group or an aryl group. When $m_{201}$ represents 2, $R_{204}$ and $R_{204}$ may be combined to form a hydrocarbon ring or a heterocyclic ring. The ring formed is preferably a 5- or 6-membered ring. $Q_{201}$ represents a sulfur atom, an oxygen atom, a selenium atom or >N—$R_{205}$, and $R_{205}$ has the same meaning as $R_{203}$. $j_{201}$, $R_{201}$, $X^-_{201}$ and $n_{201}$ have the same meanings as $j_{101}$, $k_{101}$, $X^-_{101}$ and $n_{101}$, respectively.

(III)

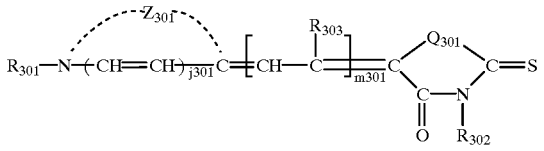

In formula (III), $Z_{301}$ represents an atomic group necessary for forming a nitrogen-containing heterocyclic ring. The nitrogen-containing heterocyclic ring includes those described with respect to $Z_{101}$ and $Z_{102}$ and specific examples thereof additionally include nuclei such as thiazolidine, thiazoline, benzothiazoline, naphthothiazoline, selenazolidine, selenazoline, benzoselenazoline, naphthoselenazoline, benzoxazoline, naphthoxazoline, dihydropyridine, dihydroquinoline, benzimidazoline and naphthoimidazoline. $Q_{301}$ has the same meaning as $Q_{201}$. $R_{301}$ has the same meaning as $R_{101}$ or $R_{102}$, and $R_{302}$ has the same meaning as $R_{203}$. $m_{301}$ has the same meaning as $m_{201}$. $R_{303}$ has the same meaning as $R_{204}$ and when $m_{301}$ represents 2 or 3, $R_{303}$ may be combined with another $R_{303}$ to form a hydrocarbon ring or a heterocyclic ring. $j_{301}$ has the same meaning as $j_{101}$.

The CR compound elevates the selectivity of the initial formation site of a new phase more rich in silver bromide than the host grain and additionally, the CR compound prevents such a reaction that the new phase initially formed repeatedly recrystallizes the surface of the host grain to the silver halide grain formed by this method, a new phase more rich in silver bromide than the host grain is epitaxially grown in the vicinity of the apex of the host grain having a silver chloride content of 90 mol % or more and a region with gentile transition in the halogen composition may be formed between the new phase and the host grain. This grain structure can be observed by various analysis methods. From the change in the form of a grain observed through an electron microscope, joining of a new phase to the vicinity of the apex of a grain is known.

Further, the halogen compositions of the host grain and the new phase can be determined by the X-ray diffraction method. The surface average halogen composition can be determined by the XPS (X-ray Photoelectron Spectroscopy) method, for example, using a spectroscope Model ESCA750 manufactured by Shimadzu-du Pont. This measurement method is specifically described in Someno and Yasumorii, *Hyomen Bunseki* (*Surface Analysis*), Kodansha (1977). From the halogen compositions of the host grain and the new phase determined by the X-ray diffraction method and the surface average silver halide composition determined by XPS, the proportion of the new phase more rich in silver bromide than the host grain occupying the entire surface can be roughly estimated. For specifying the site where the new phase more rich in silver bromide than the host grain is present or for determining the occupation ratio of the phase in the vicinity of the apex of a grain, the EDX (Energy Dispersive X-ray analysis) method using an EDX spectrometer equipped with a transmission-type electron microscope may be used other than the above-described method by the observation through an electron microscope. This measurement method is specifically described in Hiroyoshi Soejima, *Denshi-sen Microanalysis* (*Electron Beam Microanalysis*), Nikkan Kogyo Shinbun Sha (1987). The new phase of the present invention is preferably localized in the vicinity of the apex of a host grain and the surface average halogen composition preferably has a silver bromide content of 15 mol % or less, more preferably 10 mol % or less. If the average silver bromide content on the surface increases, the degree of localization of the new phase to the vicinity of the apex is in turn reduced and at the same time, the sensitivity decreases. The new phase formed by a preferred embodiment of the production process of the present invention is observed through an electron microscope and found to have a form epitaxially joined and grown to the corner part of a host grain.

The preferred grain size of the silver bromide fine emulsion for use in the present invention varies depending on the size or halogen composition of the host grain, however, it is usually 0.3 μm or less, preferably 0.1 μm or less. The halogen composition of the silver bromide fine grain emulsion must have a silver bromide content higher than the host grain and preferably has a bromide concentration of 30 mol % or more, more preferably 50 mol % or more. The silver bromide fine grain emulsion may contain silver iodide, if desired. The total amount of bromine or bromide ion supplied representatively in the addition of a silver bromide fine grain emulsion is preferably, in terms of silver, from 0.01 to 5 mol %, more preferably from 0.05 to 1.5 mol %, based on silver halide of the host grain. The temperature at the mixing may be freely selected between 30° C. and 80° C. but is preferably from 40 to 60° C.

The CR compound represented by formula (I), (II) or (III) for use in the present invention can also function as a sensitizing dye and is advantageous for elevating the spectral sensitivity. In particular, by the partial recrystallization on the surface, the spectral sensitivity can be further stabilized. For increasing the sensitivity and stability, the CR compound may be combined with another sensitizing dye or may be used in combination with a supersensitizer. For example, an aminostilbenzene compound substituted by a nitrogen-containing heterocyclic nucleus group (for example, the compound represented by formula (I) of JP-A-62-1747385, particularly Compounds (I-1) to (I-17); and those described in U.S. Pat. Nos. 2,933,390 and 3,635,721), an aromatic group organic acid formaldehyde condensate (for example, those described in U.S. Pat. No. 3,743,510), a cadmium salt or an azaindene compound may be contained. The combinations described in U.S. Pat. Nos. 3,615,613, 3,615,641, 3,617,295 and 3,635,721 are particularly useful. Specific compound examples of the CR compound represented by formula (I), (II) or (III) are set forth below, however, the present invention is by no means limited thereto.

CR-1

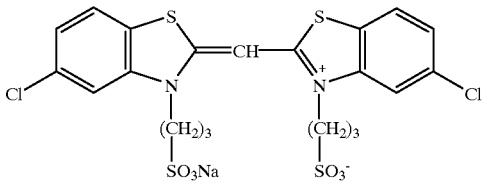

CR-2

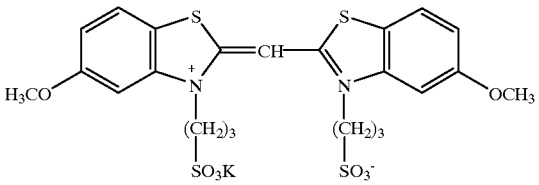

CR-3

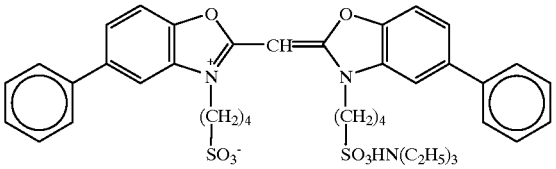

CR-4

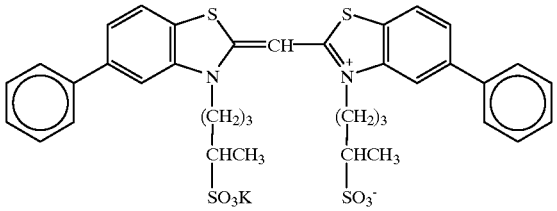

CR-5

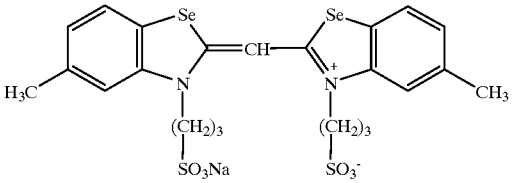

CR-6

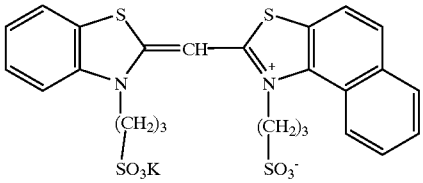

CR-7

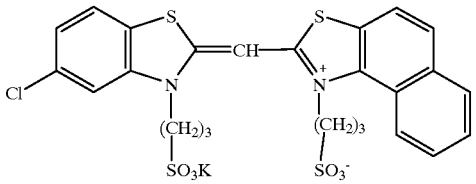

CR-8

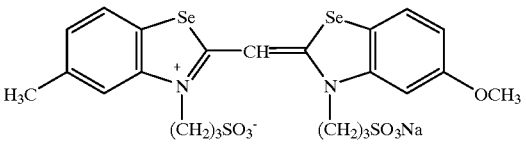

CR-9

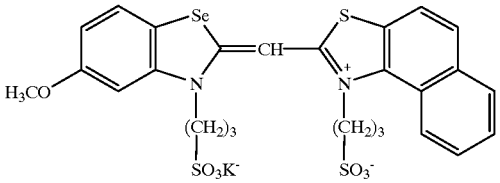

CR-10

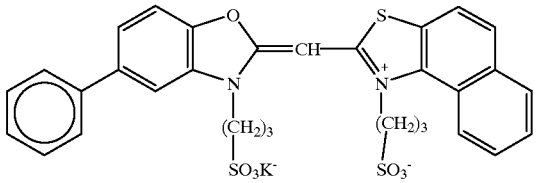

-continued
CR-11
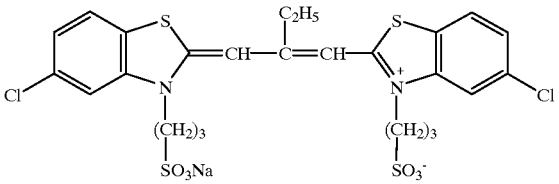
CR-12
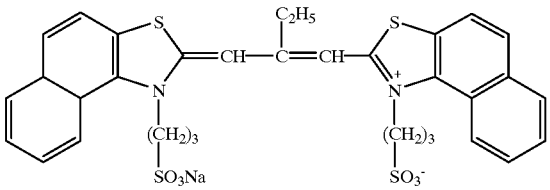
CR-13
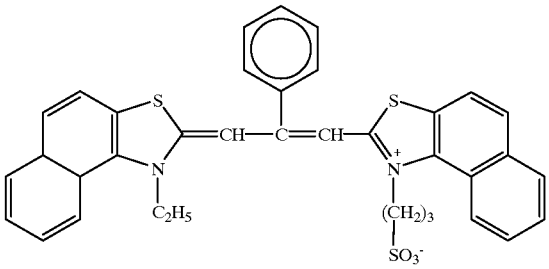
CR-14
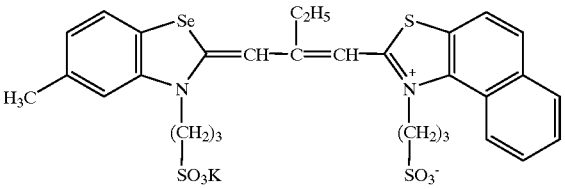
CR-15
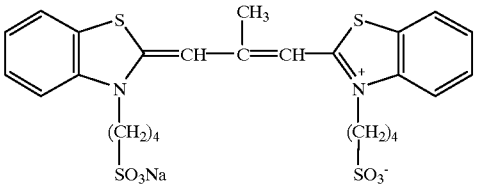
CR-16
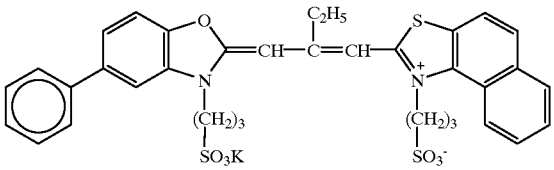
CR-17
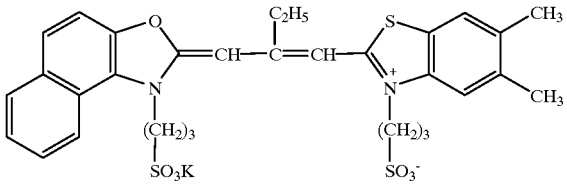
CR-18
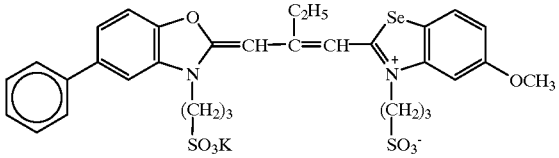
CR-19
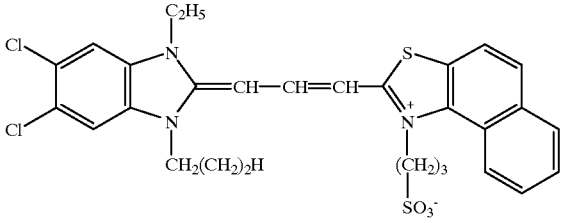
CR-20
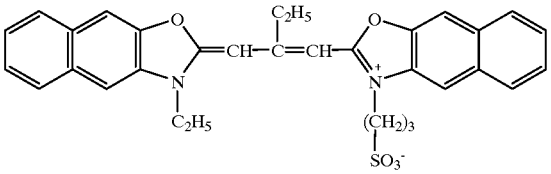
CR-21
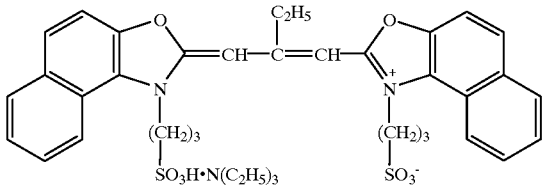
CR-22
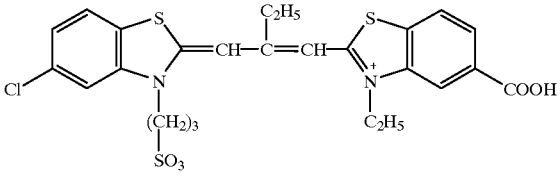

-continued
CR-23
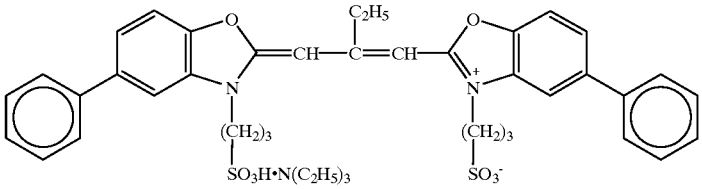
CR-24
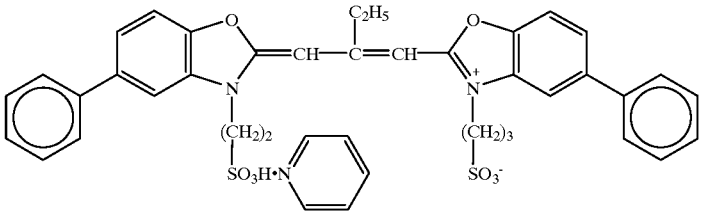
CR-25
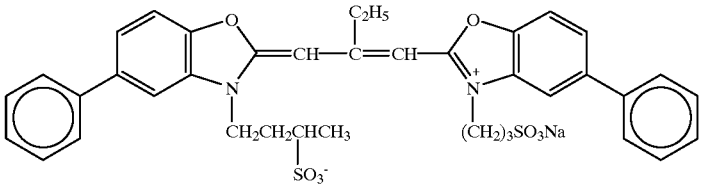
CR-26
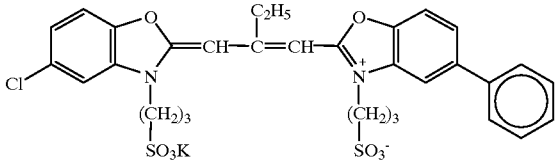
CR-27
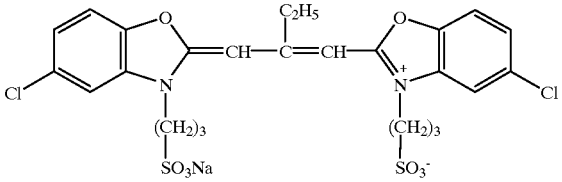
CR-28
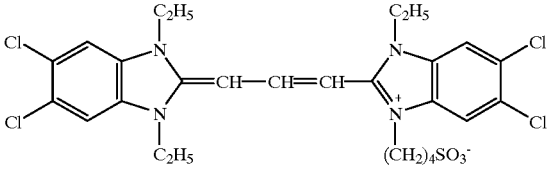
CR-29
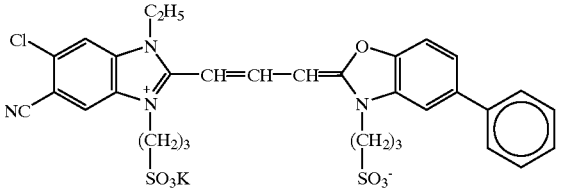
CR-30
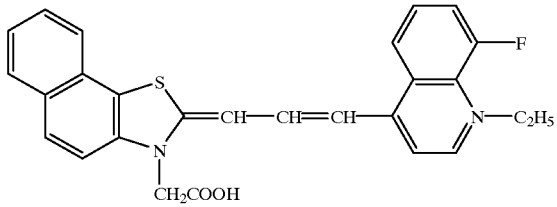
CR-31
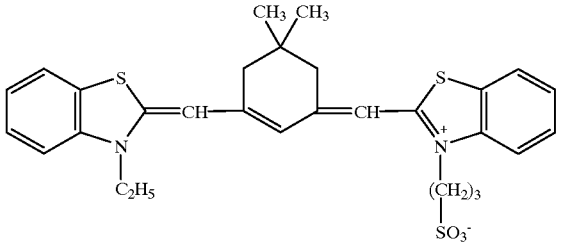
CR-32
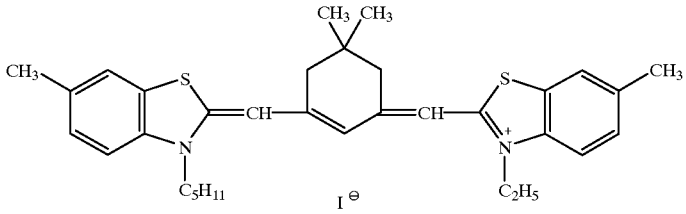

-continued
CR-33
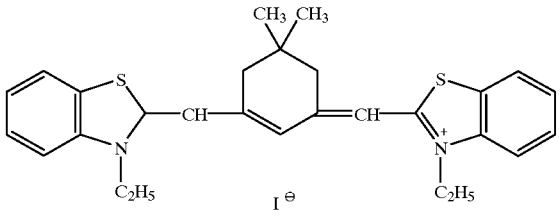
CR-34
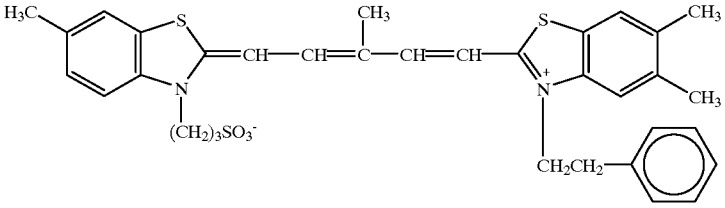
CR-35
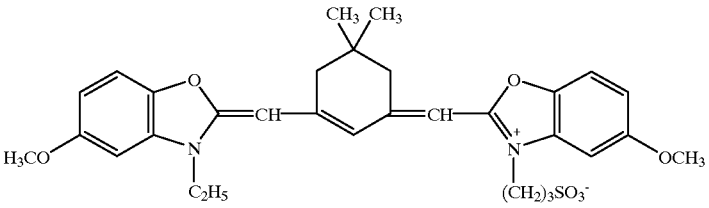
CR-36
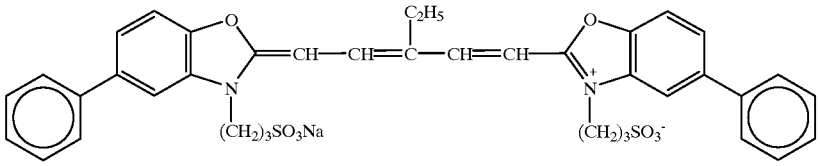
CR-37
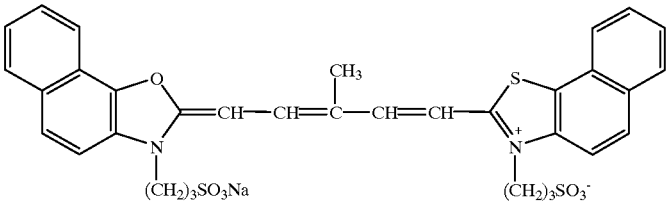
CR-38
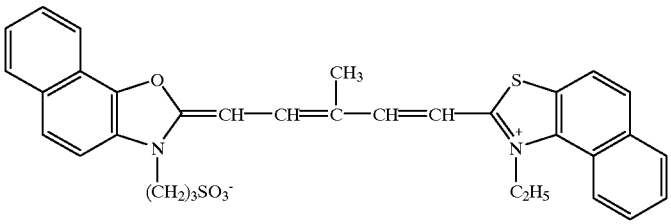
CR-39
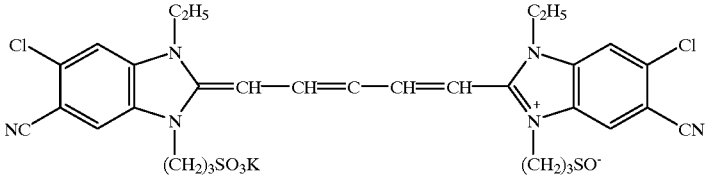

-continued
CR-40
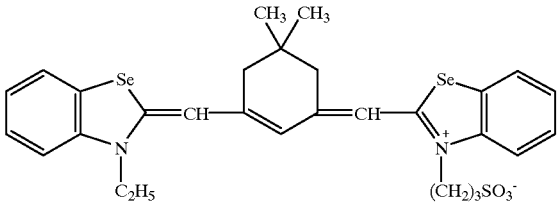
CR-41
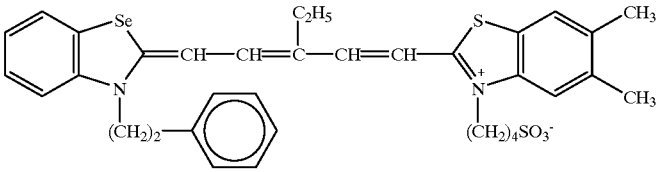
CR-42
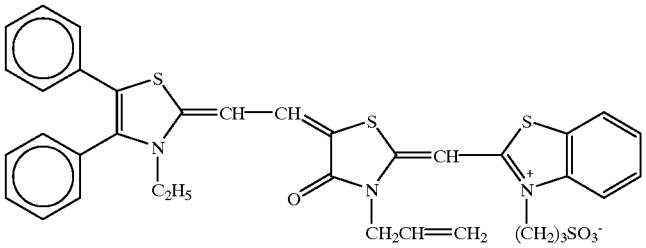
CR-43
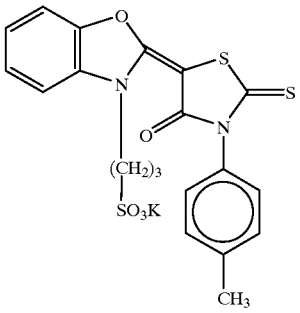
CR-44
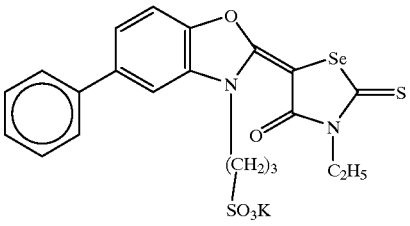
CR-45
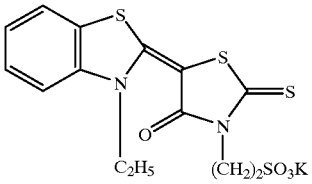
CR-46
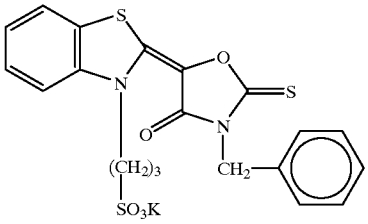
CR-47
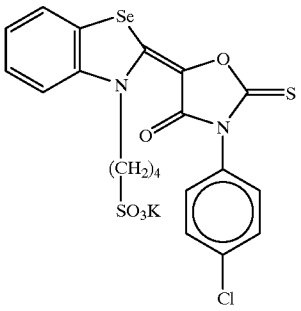
CR-48
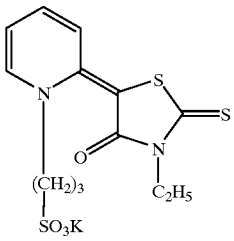

-continued

CR-49

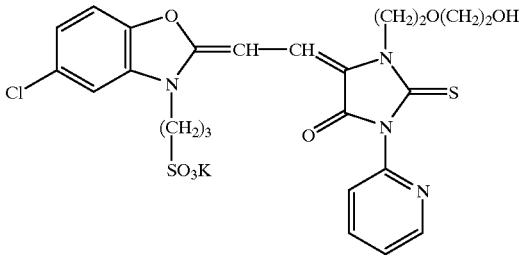

CR-50

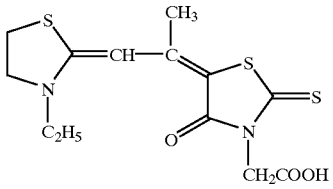

CR-51

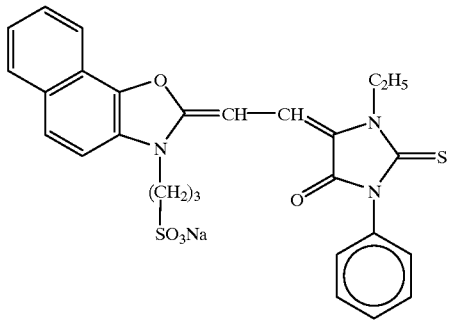

CR-52

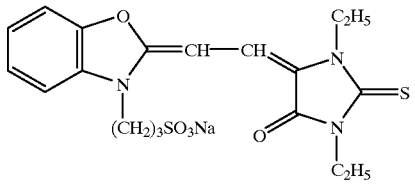

CR-53

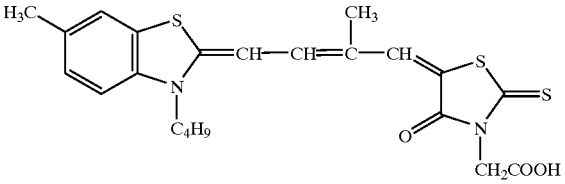

CR-54

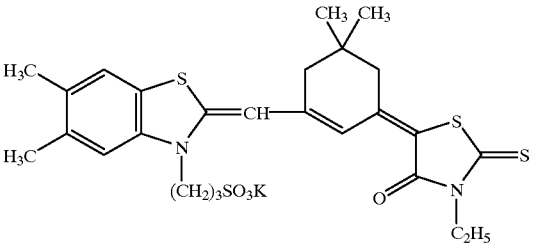

CR-55

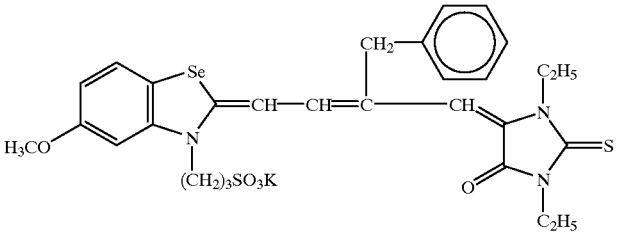

Into the silver halide emulsion of the present invention, various polyvalent metal ion impurities other than iridium may be introduced in the process of the emulsion grain formation or physical ripening. Examples of the compound which can be used in combination include salts and complex salts of iron, ruthenium, osmium, rhenium, rhodium, cadmium, zinc, lead, copper or thallium. In the present invention, a metal compound having at least 4 cyano ligands, such as iron, ruthenium, osmium and rhenium, are preferred because the high-illuminance sensitivity is further elevated and the latent image sensitization is inhibited. The amount of the compound added may be selected over a wide range depending on the purpose, but it is preferably from $10^{-9}$ to $10^{-2}$ mol per mol of silver halide.

The silver halide emulsion of the present invention is usually subjected to chemical sensitization and spectral sensitization. The chemical sensitization may be performed using sulfur sensitization represented by the addition of a labile sulfur compound, noble metal sensitization represented by gold sensitization and reduction sensitization individually or in combination. Examples of the compounds which are preferably used in the chemical sensitization include those described in JP-A-62-215272, from page 18, right lower column to page 22, right upper column.

The silver halide emulsion of the present invention is preferably subjected to gold sensitization known in the art. By applying the gold sensitization, changes in the photographic capability can be more reduced on the scanning exposure with a laser beam or the like. The gold sensitization may be performed using a compound such as a chloroauric acid or a salt thereof, a gold thiocyanate or a gold thiosulfate. The amount of the compound added varies over a wide range depending on the case, however, it is from $5\times10^{-7}$ to $5\times10^{-3}$ mol, preferably from $1\times10^{-6}$ to $1\times10^{-4}$ mol, per mol of silver halide.

In the present invention, the gold sensitization may be combined with another sensitization, for example, sulfur sensitization, selenium sensitization, tellurium sensitization, reduction sensitization or noble metal sensitization using a compound other than the gold compound.

The silver halide emulsion of the present invention may contain various compounds for the purpose of preventing fogging or stabilizing photographic capabilities, during preparation, storage or photographic processing of the emulsion or light-sensitive material. More specifically, a large number of compounds known as an antifoggant or a stabilizer may be added and examples thereof include thiazoles such as benzothiazolium salts, nitroindazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (in particular, 1-phenyl-5-mercaptotetrazole), mercaptopyrimidines and mercaptotriazines; thioketo compounds such as oxazolinethione; azaindenes such as triazaindenes, tetrazaindenes (in particular, 4-hydroxy-substituted 1,3,3a,7-tetrazaindene) and pentazaindenes; benzenethiosulfonic acid, benzenesulfinic acid and benzenesulfonic acid amide. Among these, preferred is a mercaptotetrazole because of its working of further increasing the high-illuminance sensitivity in addition to the prevention of fogging and the stabilization.

The color photographic light-sensitive material of the present invention contains a silver halide emulsion prepared by the production process of the present invention at least in one of silver halide emulsion layers. The other silver halide for use in the color light-sensitive material of the present invention may be silver chloride, silver bromide, silver (iodo)chlorobromide or silver iodobromide, but in view of the rapid processing, a high silver chloride emulsion having a silver chloride content of 90 mol % or more, more preferably 95 mol % or more, still more preferably 98 mol % or more is preferred. Of these embodiments, an embodiment where three kinds of silver halide emulsion layers different in the hue all contain the silver halide emulsion prepared by the production process of the present invention is most preferred.

For the purpose of increasing the sharpness or the like of an image, the light-sensitive material of the present invention preferably contains a dye capable of decoloration by the processing (particularly, an oxonol-base dye) described in European Patent Publication 0337490A2, pp. 27–76, which is added to a hydrophilic colloid layer such that the light-sensitive material has an optical reflection density at 680 nm of 0.70 or more, or preferably contains 12 wt % or more (more preferably, 14 wt % or more) of titanium oxide surface-treated with a di-, tri- or tetrahydric alcohol (e.g., trimethylolethane), in a water-resistant resin layer of the support.

The photographic additives which can be used in the present invention, such as cyan, magenta and yellow couplers, are preferably dissolved in a high-boiling point organic solvent before use. The high boiling organic solvent is a water-immiscible compound having a melting point of 100° C. or lower and a boiling point of 140° C. or higher, and any may be used as long as it is a good solvent for the coupler. The high boiling point organic solvent preferably has a melting point of 80° C. or lower, and preferably has a boiling point of 160° C. or higher, more preferably 170° C. or higher.

The high boiling point organic solvent is described in detail in JP-A-62-215272, from page 137, right lower column to page 144, right upper column.

The cyan, magenta or yellow coupler may be impregnated into a loadable latex polymer (see, for example, U.S. Pat. No. 4,203,716) in the presence or absence of the above-described high boiling point organic solvent or dissolved together with a water-insoluble and organic solvent-soluble polymer and then emulsion-dispersed in a hydrophilic colloid aqueous solution.

The homopolymers and copolymers described in U.S. Pat. No. 4,857,449, columns 7 to 15, and International Patent Publication WO88/00723, pages 12 to 30 are preferred, methacrylate-base or acrylamide-base polymers are more preferred, and acrylamide-base polymers are still more preferred in view of stabilization of a dye image.

The light-sensitive material of the present invention preferably uses a dye image preservability improving compound described in European Patent Publication 0277589A2 in combination with the coupler. For suppressing the latent image sensitization, the compound is particularly preferably used in combination with a pyrrolotriazole coupler and/or a pyrazoloazole coupler.

More specifically, Compound (F) which is chemically bonded with the aromatic amine-base developing agent remaining after color development to produce a chemically inactive and substantially colorless compound and/or Compound (G) which is chemically bonded with an oxidation product of the aromatic amine-base developing agent remaining after color development to produce a chemically inactive and substantially colorless compound, are preferably used simultaneously or individually, for example, for preventing staining or other side reactions due to a colored dye produced by the reaction of the color developing agent or oxidation product thereof remaining in the layer with a coupler during storage after the processing.

To the light-sensitive material of the present invention, an antifungal as described in JP-A-63-271247 is preferably added so as to prevent various molds and bacteria from proliferation in the hydrophilic colloid layer to deteriorate the image.

The support for use in the light-sensitive material of the present invention may be a white polyester-base support for display or a support having thereon a layer containing a white pigment in the side having a silver halide emulsion layer. Further, in order to improve the sharpness, an antihalation layer is preferably provided on the support in the side coated with a silver halide emulsion layer or on the back surface of the support. The support is preferably set to have a transmission density of from 0.35 to 0.8 so that the display can be viewed with either reflected light or transmitted light.

The light-sensitive material of the present invention may be exposed to visible light or infrared light. The exposure may be either low-illuminance exposure or high-illuminance short-time exposure. In the latter case, a laser scanning exposure method having an exposure time of less than $10^{-4}$ second per one pixel is preferred.

In the exposure, a band slip filter described in U.S. Pat. No. 4,880,726 is preferably used. By using this filter, light color mixing is eliminated and the color reproduction is remarkably improved.

The exposed light-sensitive material may be color-developed in a usual manner but in the case of a color light-sensitive material, it is preferably bleach-fixed after the color development for the purpose of rapid processing. When the above-described high silver chloride emulsion is used, the bleach-fixing solution preferably has a pH of about 6.5 or less, more preferably about 6 or less, so as to accelerate the desilvering.

Preferred examples of the silver halide emulsion, other materials (e.g., additives) and the photographic constituent layers (e.g., layer arrangement) which can be applied to the light-sensitive material of the present invention, and the processing method and additives for the processing which can be applied to the processing of the light-sensitive material include those described in the following patent publications, particularly, in European Patent Publication 0355660A2 (corresponding to JP-A-2-139544).

TABLES 1 TO 5

| Photographic Constituent Element, etc. | JP-A-62-215272 | JP-A-2-33144 | EP 0355660A2 |
|---|---|---|---|
| Silver halide emulsion | page 10, right upper column, line 6 to page 12, left lower column, line 5, and page 12 right lower column, line 4 from the bottom to page 13, left upper column, line 17 | page 28, right upper column, line 16 to page 29, right lower column, line 11, and page 30, lines 2 to 5 | page 45, line 54 to page 47, line 3, and page 47, lines 20 to 22 |
| Silver halide solvent | page 12, left lower column, lines 6 to 14, and page 13, left upper column, line 3 from the bottom to page 18, left lower column, the last line | — | — |
| Chemical sensitizer | page 12, left lower column, line 3 from the bottom to right lower column, line 5 from the bottom, page 18, right lower column, line 1 to page 22, right upper column, line 9 from the bottom | page 29, right lower column line 12 to the last line | page 47, lines 4 to 9 |
| Spectral sensitizer (spectral sensitization) | page 22, right upper column, line 8 from the bottom to page 38, the last line | page 30, left upper column, lines 1 to 13 | page 47, lines 10 to 15 |
| Emulsion stabilizer | page 39, left upper column, line 1 to page 72, right upper column, the last line | page 30, left upper column, line 14 to right upper column, line 1 | page 47, lines 16 to 19 |
| Development accelerator | page 72, left lower column, line 1 to page 91, right upper column, line 3 | — | — |
| Color coupler (cyan, magenta, yellow couplers) | page 91, right upper column, line 4 to page 121, left upper column, line 6 | page 3, right upper column, line 14 to page 18, left upper column, the last line, and page 30, right upper column, line 6 to page 35, right lower column, line 11 | page 4, lines 15 to 27, page 5, line 30 to page 28, the last line, page 45, lines 29 to 31, and page 47, line 23 to page 63, line 50 |
| Color formation reinforcing agent | page 121, left upper column, line 7 to page 125, right upper column, line 1 | — | — |
| Ultraviolet absorbent | page 125, right upper column, line 2 to page 127, left lower column, the last line | page 37, right lower column, line 14 to page 38, left upper column, line 11 | page 65, lines 22 to 31 |
| Discoloration inhibitor | page 127, right lower column, line 1 to page 137, left lower column, line 8 | page 36, right upper column, line 12 to page 37, left upper column, line 19 | page 4, line 30 to page 5, line 23, page 29, first line to page 45, line 25, page 45, lines 33 to 40, page 65, lines 2 to 21 |
| High-boiling point and/or low boiling point organic solvent | page 137, left lower column, line 9 to page 144, right upper column, the last line | page 35, right lower column, line 14 to page 36, left upper column, line 4 from the bottom | page 64, lines 1 to 51 |
| Dispersion method of photographic additives | page 144, left lower column, first line to page 146, right upper column, line 7 | page 27, right lower column, line 10 to page 28, left upper column, the last line, and page 35, right lower column, line 12 to page 36, right upper column, line 7 | page 63, line 51 to page 64, line 56 |
| Hardening agent | page 146, right upper column, line 8 to page 155, left lower column, line 4 | — | — |
| Developing agent precursor | page 155, left lower column, line 5 to page 155, right lower column, line 2 | — | — |
| Development inhibitor releasing compound | page 155, right lower column, lines 3 to 9 | — | — |
| Support | page 155, right lower column, line 19 to page 156, left upper column, line 14 | page 38, right upper column, line 18 to page 39, left upper column, line 3 | page 66, line 29 to page 67, line 13 |
| Light-sensitive layer structure | page 156, left upper column, line 15 to page 156, right lower column, line 14 | page 28, right upper column, lines 1 to 15 | page 45, lines 41 to 52 |
| Dye | page 156, right lower column, line 15 to page 184, right lower column, the last line | page 38, left upper column, line 12 to right upper column, line 7 | page 66, lines 18 to 22 |
| Color mixing inhibitor | page 185, left upper column, the first line to page 188, right lower column, line 3 | page 36, right upper column, lines 8 to 11 | page 64, line 57 to page 65, the first line |
| Gradation controlling agent | page 188, right lower column, lines 4 to 8 | — | — |
| Stain inhibitor | page 188, right lower column, line 9 to page 193, right lower column, line 10 | page 37, left upper column, the last line to right lower column, line 13 | page 65, line 32 to page 66, line 17 |
| Surface active agent | page 201, left lower column, line 1 to page 210, right upper column, the last line | page 18, right upper column, the first line to page 24, right lower column, the last line, and page 27, left lower column, line 10 | — |

TABLES 1 TO 5-continued

| Photographic Constituent Element, etc. | JP-A-62-215272 | JP-A-2-33144 | EP 0355660A2 |
|---|---|---|---|
| | | from the bottom to right lower column, line 9 | |
| Fluorine-containing compound (antistatic agent, coating aid, lubricant, adhesion inhibitor, etc.) | page 210, left lower column, the first line to page 222, left lower column, line 5 column, line 9 | page 25, left upper column, the first line to page 27, right lower | — |
| Binder (hydrophilic colloid) | page 222, left lower column, line 6 to page 225, left upper column, the last line | page 38, right upper column, lines 8 to 18 | page 66, lines 23 to 28 |
| Thickening agent | page 225, right upper column, the first line to page 227, right upper column, line 2 | — | — |
| Antistatic agent | page 227, right upper column, line 3 to page 230, left upper column, the first line | — | — |
| Polymer latex | page 230, left upper column, line 2 to page 239, the last line | — | — |
| Matting gent | page 240, left upper column, the first line to page 240, right upper column, the last line | — | — |
| Photographic processing method (processing step or additive) | page 3, right upper column, line 7 to page 10, right upper column, line 5 | page 39, left upper column, line 4 to page 42, left upper column, the last line | page 67, line 14 to page 69, line 28 |

Note)
The cited portion of JP-A-62-215272 includes the contents amended by the Amendment dated March 16, 1987 described at the end of this patent publication.
Of the color couplers described above, as the yellow coupler, so-called short-wave type yellow couplers described in JP-A-63-231451, JP-A-63-123047, JP-A-63-241547, JP-A-1-173499, JP-A-1-213648 and JP-A-1-250944 are also preferably used.

As the cyan coupler, in addition to the diphenylimidazole-base cyan couplers described in JP-A-2-33144, 3-hydroxypyridine-base cyan couplers described in European Patent Publication 0333185A2 (particularly preferably Coupler (42) set forth as a specific example which is a 4-equivalent coupler but rendered to be 2-equivalent by introducing a chlorine releasing group thereinto, and Couplers (6) and (9)) and cyclic active methylene-base cyan couplers described in JP-A-64-32260 (particularly preferably Couplers 3, 8 and 34 set forth as specific examples) may also be preferably used. The cyan coupler is particularly preferably a pyrrolotriazole cyan coupler described in JP-A-9-189988.

The silver halide color light-sensitive material using a high silver chloride emulsion having a silver chloride content of 90 mol % or more is preferably processed by the method described in JP-A-2-207250, page 27, left upper column to page 34, right upper column.

The present invention will be described below in greater detail by referring to the Examples but the present invention should not be construed as being limited thereto.

EXAMPLE 1

Preparation of Emulsion A

To a 3% aqueous solution of lime-processed gelatin, 3.5 g of sodium chloride was added and thereto 1.0 ml of N,N'-dimethylimidazolidine-2-thione (1% aqueous solution) was added. To the resulting aqueous solution, an aqueous solution containing 0.8 mol of silver nitrate and an aqueous solution containing 0.8 mol of sodium chloride were added and mixed at 50° C. while vigorously stirring. Subsequently, an aqueous solution containing 0.20 mol of silver nitrate and an aqueous solution containing 0.20 mol of sodium chloride were added and mixed at 50° C while vigorously stirring. At this time, $6.4\times10^{-6}$ mol of yellow prussiate of potash was simultaneously added. Thereafter, the mixed solution was water washed by sedimentation at 40° C. to effect desalting. Thereto, 80.0 g of lime-processed gelatin was added and the emulsion was adjusted to have a pH and a pAg of 7.2 to 7.0, respectively. The resulting emulsion was passed through the bromine supplying process of adding 0.004 mol as silver of silver chlorobromide fine grain emulsion (halogen ratio: Br/Cl=60/40) having a grain size of 0.05 $\mu$m at 60° C. to form a silver bromide-rich phase on the surface of a silver chloride host grain. Thereafter, $1.1\times10^{-4}$ mol/mol-Ag of a gold sensitizer (chloroauric acid), $2.7\times10^{-6}$ mol/mol-Ag of a sulfur sensitizer (triethylthiourea), $1.4\times10^{-5}$ mol/mol-Ag of red-sensitive spectral sensitizers (G and H) the same as in Example 2 and $2.6\times10^{-3}$ mol of Compound I the same as in Example 2 were added to optimally perform chemical sensitization and spectral sensitization. Further, $7.7\times10^{-4}$ mol/mol-Ag of 1-(5-methylureidophenyl)-5-mercaptotetrazole was added thereto. Into the silver chlorobromide fine grain emulsion, $1.7\times10^{-4}$ mol/mol-Ag of potassium hexachloroiridate(IV) had been previously incorporated at the grain formation thereof (hereinafter, this fine grain emulsion was referred to as Fine Grain Emulsion a). From the electron microphotograph, the grain had a cubic shape, a grain size of 0.5 $\mu$m and a coefficient of variation of 0.08. The grain size is expressed by the average of the diameters of circles equivalent to the projected areas of grains, and the grain size distribution used is a value obtained by dividing the grain size standard deviation by the average grain size.

Preparation of Emulsion B

In the preparation of Emulsion A, the amount of potassium hexachloroiridate(IV) in the silver chlorobromide fine grain was changed to $3.4\times10^{-4}$ mol/mol-Ag (hereinafter, this silver chlorobromide fine grain emulsion is referred to as Fine Grain Emulsion b).

Preparation of Emulsion C

In the preparation of Emulsion A, the amount of potassium hexachloroiridate(IV) in the silver chlorobromide fine grain was changed to $6.8\times10^{-4}$ mol/mol-Ag (hereinafter, this silver chlorobromide fine grain emulsion is referred to as Fine Grain Emulsion c).

Preparation of Emulsion D

In the preparation of Emulsion A, only the bromine supplying process was changed and a method of adding 0.001 mol as silver of Fine Grain Emulsion a at 60° C., ripening the for 5 minutes to form a silver bromide-rich phase in the vicinity of the apex of a silver chloride host grain, and further adding 0.003 mol as silver of Fine Grain Emulsion a under the same condition as above, was used.

Preparation of Emulsion E

In the preparation of Emulsion D, the silver chlorobromide fine grain emulsions added in the bromine supply process were changed such that potassium hexachloroiridate (IV) was not incorporated into the first time silver chlorobromide fine grain emulsion and the second time silver chlorobromide fine grain emulsion was added after incorporating $2.3\times10^{-4}$ mol/mol-Ag of potassium hexachloroiridate(IV) during the grain formation thereof (hereinafter, the first time fine grain emulsion is referred to as Fine Grain Emulsion d and the second time fine grain emulsion is referred to as Fine Grain Emulsion e).

Preparation of Emulsion F

In the preparation of Emulsion D, the silver chlorobromide fine grain emulsions added in the bromine supply process were changed such that Fine Grain Emulsion c was added as the first time silver chlorobromide fine grain emulsion and Fine Grain Emulsion d not containing potassium hexachloroiridate(IV) was added as the second time silver chlorobromide fine grain emulsion.

Preparation of Emulsion G

In the preparation of Emulsion F, the halogen composition of the second time silver chlorobromide fine grain emulsion added in the bromine supplying process was changed to Br/Cl=30/70.

Preparation of Emulsion H

In the preparation of Emulsion A, the bromine supplying process was changed and a method of adding Aqueous Solution (I) shown below, ripening for 4 minutes to form a silver bromide-rich phase in the vicinity of the apex of a silver chloride host grain, adding 0.003 mol as silver of Fine Grain Emulsion d at 50° C. and ripening the emulsion for 12 minutes, was used.

Aqueous Solution (I)

KBr (0.5 mol/l aqueous solution) 6.0 ml

Preparation of Emulsion I

In the preparation of Emulsion H, $1\times10^{-4}$ mol of an aqueous potassium hexachloroiridate(IV) solution was added at once 1 minute after the addition of Fine Grain Emulsion d during the bromine supplying process.

Preparation of Emulsion J

In the preparation of Emulsion H, $1\times10^{-4}$ mol of an aqueous potassium hexachloroiridate(IV) solution was added at once immediately before the addition of Aqueous Solution (I) during the bromine supplying process.

Preparation of Emulsion K

In the preparation of Emulsion J, Aqueous Solution (I) was changed to.Aqueous Solution (II) shown below.

Aqueous Solution (II)

S-3 (0.5 mol/l aqueous solution) 6.0 ml

Preparation of Emulsion L

In the preparation of Emulsion F, CR-7 ($3.0\times10^{-4}$ mol per 1.0 mol of silver halide) was added before the bromine supplying process.

Each of the emulsions prepared above was sampled at respective stages of the bromine supplying process and the ratio of the amount of unreacted Br immediately after the first time bromine supplying to the amount of unreacted Br immediately before the second time bromine supplying was examined. As a result, it is found that in any of Emulsions D to L, the second time bromine supply was effected after 90% or more of the first time formation of the silver bromide-rich phase was completed. Further, Emulsions D to F each was subjected to the atomic absorption spectrochemical analysis using the emulsions immediately before and after completion of the second time bromine supply, as a result, the iridium atom was found to be less than the limit of detection in either emulsion.

Then, 25.0 ml of ethyl acetate and 4.2 g of Solvent (solv-6) were added to 9.6 g of Cyan Coupler (ExC-1), 0.6 g of Dye Image Stabilizer (Cpd-9), 5.4 g of Dye Image Stabilizer (Cpd-20), 12 g of Dye Image Stabilizer (Cpd-1), 1.5 g of Dye Image.Stabilizer (Cpd-12) and 0.4 g of Dye Image Stabilizer (Cpd-19), and the mixture was dissolved. The resulting solution was emulsion-dispersed in 402 ml of a 10% aqueous gelatin solution containing 20.0 ml of a 10% sodium dodecylbenzenesulfonate to prepare Emulsion Dispersion A.

In total, 12 samples each having the contents shown in Table 6 were prepared. The polyethylene in the side coated with an emulsion layer and a protective layer, contained titanium dioxide and a slight amount of ultramarine. In each layer, 1-oxy-3,5-dichloro-s-triazine sodium salt was used as a hardening agent.

TABLE 6

| | | Red-Sensitive Emulsion Layer | | | | |
|---|---|---|---|---|---|---|
| Sample No. | Support | Emulsion (coated silver amount: 400 mg/m$^2$) | Emulsion Dispersion | | Protective Layer | Remarks |
| Sample 101 | Support having laminated on both surfaces thereof polyethylene | Emulsion A | Emulsion dispersion A | | Gelatin coated amount: 1,340 mg/m$^2$ | Comparison |
| Sample 102 | | Emulsion B | Cyan Coupler (ExCl) | 320 mg/m$^2$ | | " |
| Sample 103 | | Emulsion C | Dye Image Stabilizer | (Cpd-9) 30 mg/m$^2$ | | " |
| Sample 104 | | Emulsion D | Dye Image Stabilizer | (Cpd-19) 20 mg/m$^2$ | | " |
| Sample 105 | | Emulsion E | Dye Image Stabilizer | (Cpd-20) 18 mg/m$^2$ | | " |
| Sample 106 | | Emulsion F | Dye Image Stabilizer | (Cpd-1) 40 mg/m$^2$ | | Invention |
| Sample 107 | | Emulsion G | Dye Image Stabilizer | (Cpd-12) 5 mg/m$^2$ | | " |
| Sample 108 | | Emulsion H | Solvent (Solv-6) | 140 mg/m$^2$ | | Comparison |
| Sample 109 | | Emulsion I | | | | |
| Sample 110 | | Emulsion J | Gelatin was added to the coating solution to have a gelatin coated amount of 1,340 mg/m$^2$. | | | Invention |
| Sample 111 | | Emulsion K | | | | " |
| Sample 112 | | Emulsion L | | | | " |

These coated samples were tested as follows to examine the photographic properties. First, the coated samples each was subjected to gradation exposure for sensitometry using a sensitometer (Model FWH manufactured by Fuji Photo Film Co., Ltd. or SMP-201A manufactured by Yamashita Denso KK). The exposure amount at this time was 300 CMS and the exposure was performed through an interference filter loaded of 680 nm with low illuminance for 10 seconds or high illuminance for $10^{-6}$ second. Then, 10 seconds after the exposure or 2 hours after the exposure, the -following color development processing was performed.

| Processing Step | Temperature (° C.) | Time (sec) |
|---|---|---|
| Color development | 35 | 45 |
| Bleach-fixing | 35 | 45 |
| Water washing | 28–35 | 90 |

Color Developer:

| | |
|---|---|
| Triethanolamine | 8.12 g |
| N-N-Diethylhydroxylamine | 4.93 g |
| Fluorescent whitening agent (UVITEX CK, produced by CIBA Geigy) | 2.80 g |
| 4-Amino-3-methyl-N-ethyl-N-[β-(methanesulfonamido)ethyl]-p-phenylenediamine sulfate | 4.96 g |
| Sodium sulfite | 0.13 g |
| Potassium carbonate | 18.40 g |
| Potassium hydrogencarbonate | 4.85 g |
| EDTA.2Na.$2H_2O$ | 2.20 g |
| Sodium chloride | 1.36 g |

-continued

| | |
|---|---|
| Water to make | 1,000 ml |
| pH | 10.05 |
| Bleach-Fixing Solution: | |
| Ammonium thiosulfate (54 wt%) | 103.0 ml |
| $NH_4$ EDTA.Fe | 54.10 mg |
| EDTA.2Na.$2H_2O$ | 3.41 g |
| Sodium sulfite | 16.71 g |
| Glacial acetic acid | 8.61 g |
| Water to make | 1,000 ml |
| pH | 5.44 |

After the processing, each sample was measured on the color density and the sensitivity and gradation were determined. The sensitivity is designated by the reciprocal of the exposure amount necessary for giving a color density 1.0 higher than the minimum color density and shown as a relative value by taking the sensitivity at the time when Sample 101 was exposed for 10 seconds and after 2 hours, subjected to development processing or when Sample 101 was exposed for $10^{-6}$ second and after 2 hours, subjected to development processing, as 100. The change in gradation due to the high illuminance law failure is outstanding particularly in the shoulder part and accordingly, the gradation is shown by the difference between the logarithm of the exposure amount necessary for giving a color density of 1.5 and the logarithm of the exposure amount necessary for giving a color density of 2.0. The smaller the value, the higher the contract. The results obtained are shown in Tables 7 and 8 below.

TABLE 7

| Sample No. | Emulsion Name | 10" Exposure and Processing After 2 Hours: Sensitivity | 10" Exposure and Processing After 2 Hours: Gradation | $10^{-6}$ Exposure and Processing After 2 Hours: Sensitivity | $10^{-6}$ Exposure and Processing After 2 Hours: Gradation | Difference in Sensitivity | Difference in Gradation | Remarks |
|---|---|---|---|---|---|---|---|---|
| Sample 101 | Emulsion A | 100 | 0.05 | 100 | 0.25 | 0 | 0.20 | Comparison |
| Sample 102 | Emulsion B | 100 | 0.08 | 110 | 0.20 | 10 | 0.12 | " |
| Sample 103 | Emulsion C | 90 | 0.10 | 110 | 0.15 | 20 | 0.05 | " |
| Sample 104 | Emulsion D | 100 | 0.05 | 100 | 0.25 | 0 | 0.20 | " |
| Sample 105 | Emulsion E | 95 | 0.05 | 95 | 0.25 | 0 | 0.20 | " |
| Sample 106 | Emulsion F | 100 | 0.05 | 150 | 0.10 | 50 | 0.05 | Invention |
| Sample 107 | Emulsion G | 100 | 0.05 | 160 | 0.07 | 60 | 0.02 | " |
| Sample 108 | Emulsion H | 100 | 0.05 | 85 | 0.25 | −15 | 0.20 | Comparison |
| Sample 109 | Emulsion I | 95 | 0.05 | 100 | 0.25 | 5 | 0.20 | " |
| Sample 110 | Emulsion J | 100 | 0.06 | 160 | 0.08 | 60 | 0.02 | Invention |
| Sample 111 | Emulsion K | 100 | 0.06 | 160 | 0.07 | 60 | 0.01 | " |
| Sample 112 | Emulsion L | 100 | 0.05 | 165 | 0.05 | 65 | 0.00 | " |

* The larger the difference in sensitivity, the smaller the high illuminance law failure.
* the closer to 0 the difference in gradation, the smaller the high illuminance law failure.

TABLE 8

| Sample No. | Emulsion Name | Sensitivity on 10" Exposure: Development Processing 10" after Exposure | Sensitivity on 10" Exposure: Development Processing 2 Hours after Exposure | Sensitivity on 10" Exposure: Difference in Sensitivity | Sensitivity on $10^{-6}$ Exposure: Development Processing 10" after Exposure | Sensitivity on $10^{-6}$ Exposure: Development Processing 2 Hours after Exposure | Sensitivity on $10^{-6}$ Exposure: Difference in Sensitivity | Remarks |
|---|---|---|---|---|---|---|---|---|
| Sample 101 | Emulsion A | 95 | 100 | 5 | 75 | 100 | 25 | Comparison |
| Sample 102 | Emulsion B | 90 | 100 | 10 | 75 | 110 | 35 | " |
| Sample 103 | Emulsion C | 80 | 90 | 10 | 65 | 110 | 45 | " |
| Sample 104 | Emulsion D | 95 | 100 | 5 | 75 | 100 | 25 | " |
| Sample 105 | Emulsion E | 90 | 95 | 5 | 75 | 95 | 20 | " |

TABLE 8-continued

| Sample No. | Emulsion Name | Sensitivity on 10" Exposure: Development Processing 10" after Exposure | Sensitivity on 10" Exposure: Development Processing 2 Hours after Exposure | Sensitivity on 10" Exposure: Difference in Sensitivity | Sensitivity on $10^{-6}$ Exposure: Development Processing 10" after Exposure | Sensitivity on $10^{-6}$ Exposure: Development Processing 2 Hours after Exposure | Sensitivity on $10^{-6}$ Exposure: Difference in Sensitivity | Remarks |
|---|---|---|---|---|---|---|---|---|
| Sample 106 | Emulsion F | 95 | 100 | 5 | 140 | 150 | 10 | Invention |
| Sample 107 | Emulsion G | 95 | 100 | 5 | 150 | 160 | 10 | " |
| Sample 108 | Emulsion H | 95 | 100 | 5 | 85 | 85 | 0 | Comparison |
| Sample 109 | Emulsion I | 90 | 95 | 5 | 85 | 100 | 15 | " |
| Sample 110 | Emulsion J | 95 | 100 | 5 | 150 | 160 | 10 | Invention |
| Sample 111 | Emulsion K | 95 | 100 | 5 | 150 | 160 | 10 | " |
| Sample 112 | Emulsion L | 95 | 100 | 5 | 160 | 165 | 5 | " |

* The larger the difference in sensitivity, the larger the change in sensitivity due to the time after exposure until processing.

It is seen from these Tables that as in Emulsion A to C, by merely increasing the amount of iridium in the silver bromide-rich phase, the high illuminance law failure may be slightly reduced (see, Table 7) but change in the sensitivity due to the time after exposure until processing is great (see, Table 8). However, as in Emulsion F, when iridium is closed inside the silver bromide-rich phase, the high illuminance law failure is remarkably improved (see, Table 7) while successfully suppressing the change in sensitivity due to the time after exposure until processing. In particular, the effect is great in Emulsion L where the silver bromide-rich phase is formed in the presence of CR-7.

Further, Samples 101 to 112 prepared above each was exposed with high illuminance for $10^{-6}$ second in an atmosphere such that the temperature and humidity in the room were 25° C. and 55% (relative humidity) or 25° C. and 85% (relative humidity). After 2 hours passed, each sample was subjected to the above-described color development processing.

After the development processing, each sample was measured on the color density and the sensitivity was determined. The sensitivity is designated in the same manner as above and the sensitivity of Sample 101 exposed in an atmosphere of 25° C. and 55% (relative humidity) is taken as 100.

The results obtained are shown in Table 9 below.

TABLE 9

| Sample No. | Emulsion | Sensitivity when Exposed for $10^{-6}$ Second and Processed after 2 Hours: 25° C.-55% | Sensitivity when Exposed for $10^{-6}$ Second and Processed after 2 Hours: 25° C.-85% | Difference in Sensitivity | Remarks |
|---|---|---|---|---|---|
| Sample 101 | Emulsion A | 100 | 80 | 20 | Comparison |
| Sample 102 | Emulsion B | 110 | 80 | 30 | " |
| Sample 103 | Emulsion C | 110 | 80 | 30 | " |
| Sample 104 | Emulsion D | 100 | 80 | 20 | " |
| Sample 105 | Emulsion E | 95 | 70 | 25 | " |
| Sample 106 | Emulsion F | 150 | 140 | 10 | Invention |
| Sample 107 | Emulsion G | 160 | 145 | 15 | " |
| Sample 108 | Emulsion H | 85 | 80 | 5 | Comparison |
| Sample 109 | Emulsion I | 100 | 80 | 20 | " |
| Sample 110 | Emulsion J | 160 | 155 | 5 | Invention |
| Sample 111 | Emulsion K | 160 | 150 | 10 | " |
| Sample 112 | Emulsion L | 165 | 165 | 0 | " |

*The smaller the difference in the sensitivity, the smaller the reduction in the sensitivity due to high-humidity exposure.

As seen from Table 9, in Sample 108 not using an iridium compound, the reduction in the sensitivity on exposure at a high humidity (hereinafter called high-humidity desensitization), but in Samples 101 to 103 using an iridium compound in an increased amount, the high-humidity desensitization was extremely great. On the other hand, in Samples 106, 107 and 110 to 112 of the present invention, containing an iridium compound only in the inside of the silver bromide-rich phase, the high-humidity desensitization was small as compared with comparative samples.

EXAMPLE 2

A paper support with both surfaces thereof being covered with polyethylene resin was surface treated by the corona discharging, a gelatin undercoat layer containing sodium dodecylbenzenesulfonate was provided thereon and the first to seventh photographic constituent layers were further coated thereon in sequence to prepare a silver halide color photographic light-sensitive material Sample (201) having the following layer structure. The coating solution for each photographic constituent layer was prepared as follows.

Preparation of Coating Solution for Fifth Layer 130 g of Cyan Coupler (ExC-2), 30 g of Cyan Coupler (ExC-3), 50 g of Dye Image Stabilizer (Cpd-1), 50 g of Dye Image Stabilizer (Cpd-6), 20 g of Dye Image Stabilizer (Cpd-7), 40 g of Dye Image Stabilizer (Cpd-9), 10 g of Dye Image Stabilizer (Cpd-10), 10 g of Dye Image Stabilizer (Cpd-14), 60 g of Dye Image Stabilizer (Cpd-15), 90 g of Dye Image Stabilizer (Cpd-16), 90 g of Dye Image Stabilizer (Cpd-17) and 10 g of Dye Image Stabilizer (Cpd-18) were dissolved in 150 g of Solvent (Solv-5), 50 g of Solvent (Solv-8), 100 g of Solvent (Solv-9) and 350 ml of ethyl acetate. The resulting solution was emulsion-dispersed in 6,500 g of a 10% aqueous gelatin solution containing 200 ml of a 10% sodium dodecylbenzenesulfonate to prepare Emulsion Dispersion C.

Emulsion Dispersion C and Emulsion A prepared in Example 1 were mixed and dissolved to prepare a coating solution for the fifth layer to have the composition shown below. The coated amount of the emulsion is a coated amount in terms of silver.

The coating solutions for the first to fourth layers and for the six and seventh layers were also prepared in the same manner as the coating solution for the fifth layer. To each layer, 1-oxy-3,5-dichloro-s-triazine sodium salt was added as a gelatin hardening agent.

Further, Ab-1, Ag-2, Ab-3 and Ab-4 were added to each layer to have a total amount of 15.0 mg/m$^2$, 60.0 mg/m$^2$, 5.0 mg/m$^2$ and 10.0 mg/m$^2$, respectively.

Antiseptic (Ab-1)

(Ab-1)

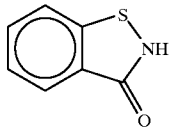

Antiseptic (Ab-2)

(Ab-2)

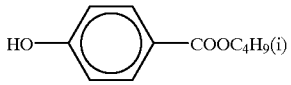

Antiseptic (Ab-3)

(Ab-3)

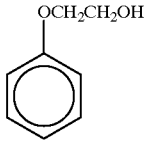

Antiseptic (Ab-4)
A 1:1:1:1 (by mol) mixture of a, b, c and d:

(Ab-4)

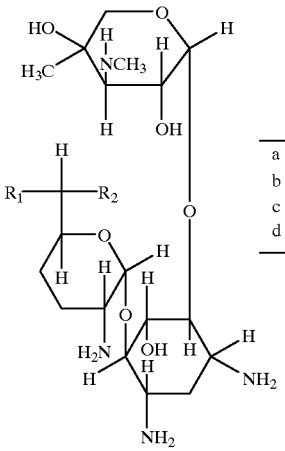

| | $R_1$ | $R_2$ |
|---|---|---|
| a | $CH_3$ | $NHCH_3$ |
| b | $CH_3$ | $NH_2$ |
| c | H | $NH_2$ |
| d | H | $NHCH_3$ |

In the silver chlorobromide emulsion of each light-sensitive emulsion layer, the following spectral sensitizing dye was used.

Blue-Sensitive Emulsion Layer (Sensitizing Dye A)

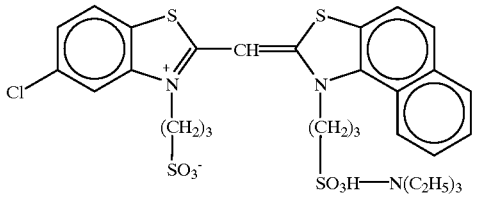

(Sensitizing Dye B)

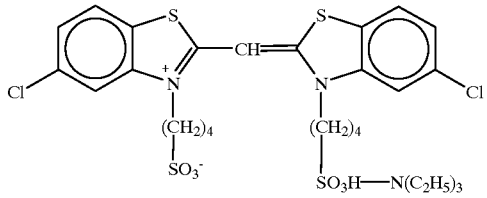

(Sensitizing Dye C)

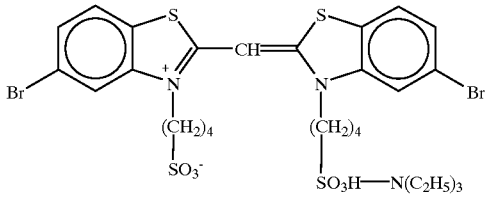

(Sensitizing Dyes A, B and C were added to the large-size emulsion each in an amount of $1.4\times10^{-4}$ mol per mol of silver halide and to the small-size emulsion each in an amount of $1.7\times10^{-4}$ mol per mol of silver halide.)

Green-Sensitive Emulsion Layer (Sensitizing Dye D)

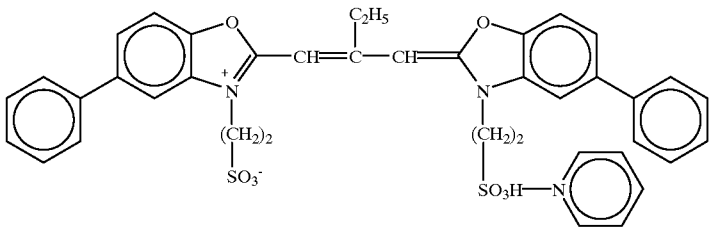

-continued (Sensitizing Dye E)

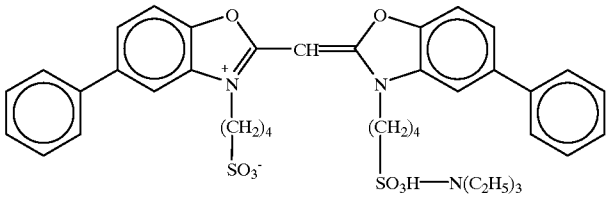

(Sensitizing Dye F)

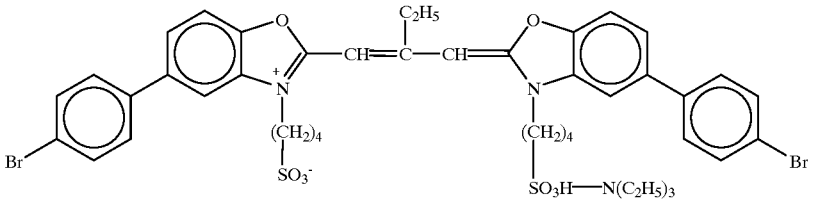

(Sensitizing Dye D was added to the large-size emulsion in an amount of $3.0\times10^{-4}$ mol per mol of silver halide and to the small-size emulsion in an amount of $3.6\times10^{-4}$ mol per mol of silver halide, Sensitizing Dye E was added to the large-size emulsion in an amount of $4.0\times10^{-5}$ mol per mol of silver halide and to the small-size emulsion in an amount of $7.0\times10^{-5}$ mol per mol of silver halide, and Sensitizing Dye F was added to the large-size emulsion in an amount of $2.0\times10^{-4}$ mol per mol of silver halide and to the small-size emulsion in an amount of $2.8\times10^{-4}$ mol per mol of silver halide.)

Red-Sensitive Emulsion Layer (Sensitizing Dye G)

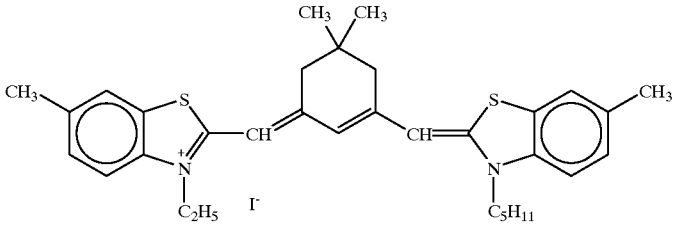

(Sensitizing Dye H)

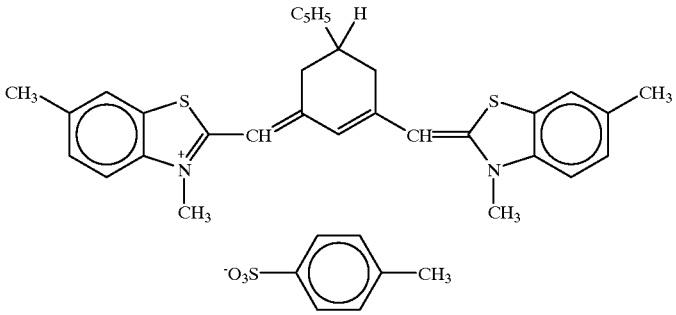

-continued (Compound I)

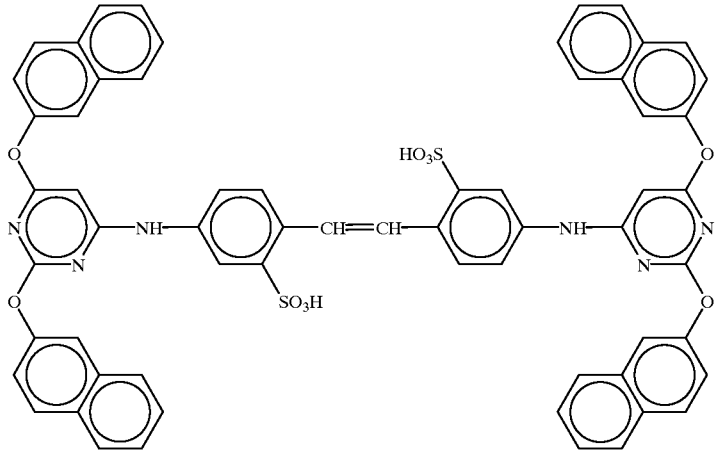

Further, 1-(3-methylureidophenyl)-5-mercaptotetrazole was added to the blue-sensitive emulsion layer, the green-sensitive emulsion layer and the red-sensitive emulsion layer in an amount of $3.3\times10^{-4}$ mol, $1.0\times10^{-3}$ mol and $5.9\times10^{-4}$ mol, respectively, per mol of silver halide.

Furthermore, the compound was added also to the second layer, the fourth layer, the sixth layer and the seventh layer to have a coverage of 0.2 mg/m$^2$, 0.2 mg/m$^2$, 0.6 mg/m$^2$ and 0.1 mg/m$^2$, respectively.

In addition, 4-hydroxy-6-methyl-1,3,3a,7-tetrazaindene was added to the blue-sensitive emulsion layer and the green-sensitive emulsion layer in an amount of $1\times10^{-4}$ mol and $2\times10^{-4}$ mol, respectively, per mol of silver halide.

Further, a copolymer of methacrylic acid and butyl acrylate (1:1 by weight, average molecular weight: 200,000 to 400,000) was added to the red-sensitive emulsion layer in an amount of 0.05 g/m$^2$.

Furthermore, disodium catechol-3,5-disulfonate was added to the second layer, the fourth layer and the sixth layer to have a coverage of 6 mg/m$^2$, 6 mg/m$^2$ and 18 mg/M$^2$, respectively.

In addition, the following dyes (the numeral in the parenthesis shows the coated amount) were added to the emulsion layers for the purpose of preventing irradiation.

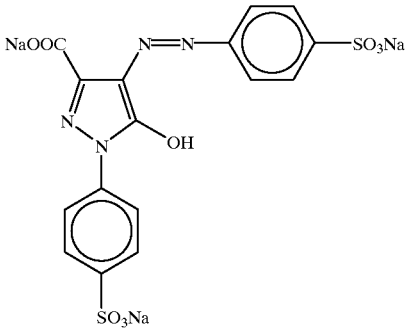

(10 mg/m$^2$)

-continued

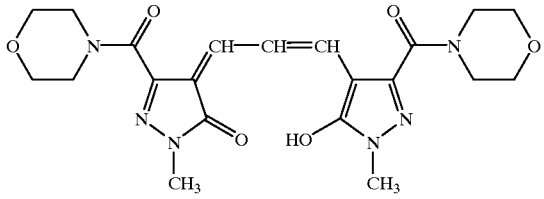

(20 mg/m$^2$)

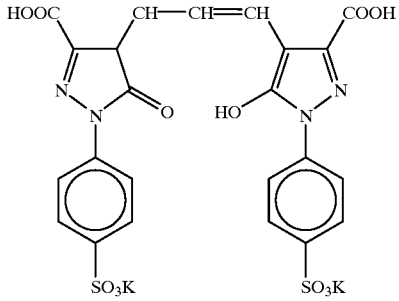

(5 mg/m$^2$)

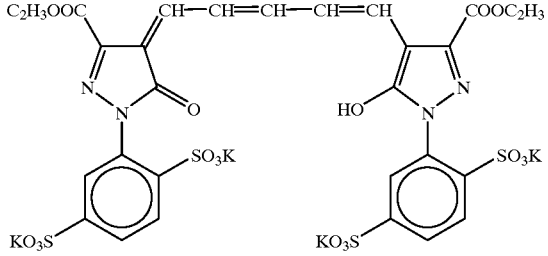

(20 mg/m$^2$)

-continued

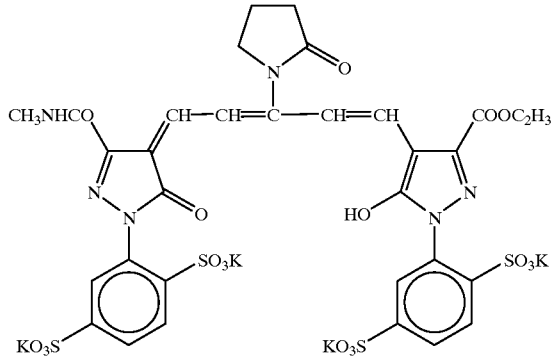

(20 mg/m$^2$)

Layer Structure

The structure of each layer is shown below. The numeral shows the coated amount (g/m$^2$). In the case of the silver halide emulsion, the coated amount is a coated amount in terms of silver.

Support

Polyethylene resin laminated paper

[The polyethylene resin in the first layer side contains a white pigment ($TiO_2$, content: 16 wt %; ZnO, content: 4 wt %), a fluorescent whitening agent (a 8:2 mixture of 4,4'-bis(benzoxazolyl)stilbene and 4,4'-bis(5-methylbenzoxazolylstilbene, content: 0.05 wt %), and a bluish dye (ultramarine).]

| | |
|---|---|
| First Layer (blue-sensitive emulsion layer): | |
| Silver chlorobromide emulsion (cubic; a 3:7 (by mol as silver) mixture of Large-Size Emulsion A having an average grain size of 0.72 μm and Small-Size Emulsion A having an average grain size of 0.60 μm, having a coefficient of variation in the grain size distribution of 0.08 and 0.10, respectively; both emulsions of respective sizes containing 0.3 mol % of silver bromide partially localized on the surface of a grain using silver chloride as the substrate) | 0.26 |
| Gelatin | 1.35 |
| Yellow Coupler (ExY) | 0.62 |
| Dye Image Stabilizer (Cpd-1) | 0.08 |
| Dye Image Stabilizer (Cpd-2) | 0.04 |
| Dye Image Stabilizer (Cpd-3) | 0.08 |
| Solvent (Solv-1) | 0.23 |
| Second Layer (color mixing inhibiting layer): | |
| Gelatin | 0.99 |
| Color Mixing Inhibitor (Cpd-4) | 0.09 |
| Dye Image Stabilizer (Cpd-5) | 0.018 |
| Dye Image Stabilizer (Cpd-6) | 0.13 |
| Dye Image Stabilizer (Cpd-7) | 0.01 |
| Solvent (Solv-1) | 0.06 |
| Solvent (Solv-2) | 0.22 |
| Third Layer (green-sensitive emulsion layer): | |
| Silver Chlorobromide Emulsion B (cubic; a 1:3 (by mol as silver) mixture of Large-Size Emulsion B having an average grain size of 0.45 μm and Small-Size Emulsion B having an average grain size of 0.35 μm, having a coefficient of variation in the grain size distribution of 0.10 and 0.08, respectively; both emulsions of respective sizes containing 0.4 mol % of silver bromide partially localized on the surface of a grain using silver chloride as the substrate) | 0.14 |
| Gelatin | 1.36 |
| Magenta Coupler (ExM) | 0.15 |
| Ultraviolet Absorbent (UV-1) | 0.05 |
| Ultraviolet Absorbent (UV-2) | 0.03 |
| Ultraviolet Absorbent (UV-3) | 0.02 |
| Ultraviolet Absorbent (UV-4) | 0.04 |
| Dye Image Stabilizer (Cpd-2) | 0.02 |
| Dye Image Stabilizer (Cpd-4) | 0.002 |
| Dye Image Stabilizer (Cpd-6) | 0.09 |
| Dye Image Stabilizer (Cpd-8) | 0.02 |
| Dye Image Stabilizer (Cpd-9) | 0.03 |
| Dye Image Stabilizer (Cpd-10) | 0.01 |
| Dye Image Stabilizer (Cpd-11) | 0.0001 |
| Solvent (Solv-3) | 0.11 |
| Solvent (Solv-4) | 0.22 |
| Solvent (Solv-5) | 0.20 |
| Fourth Layer (color mixing inhibiting layer): | |
| Gelatin | 0.71 |
| Color Mixing Inhibitor (Cpd-4) | 0.06 |
| Dye Image Stabilizer (Cpd-5) | 0.013 |
| Dye Image Stabilizer (Cpd-6) | 0.10 |
| Dye Image Stabilizer (Cpd-7) | 0.007 |
| Solvent (Solv-1) | 0.04 |
| Solvent (Solv-2) | 0.16 |
| Fifth Layer (red-sensitive emulsion layer): | |
| Emulsion A in Example 1 | 0.12 |
| Gelatin | 1.11 |
| Cyan Coupler (ExC-2) | 0.13 |
| Cyan Coupler (ExC-3) | 0.03 |
| Dye Image Stabilizer (Cpd-1) | 0.05 |
| Dye Image Stabilizer (Cpd-6) | 0.05 |
| Dye Image Stabilizer (Cpd-7) | 0.02 |
| Dye Image Stabilizer (Cpd-9) | 0.04 |
| Dye Image Stabilizer (Cpd-10) | 0.01 |
| Dye Image Stabilizer (Cpd-14) | 0.01 |
| Dye Image Stabilizer (Cpd-15) | 0.06 |
| Dye Image Stabilizer (Cpd-16) | 0.09 |
| Dye Image Stabilizer (Cpd-17) | 0.09 |
| Dye Image Stabilizer (Cpd-18) | 0.01 |
| Solvent (Solv-5) | 0.15 |
| Solvent (Solv-8) | 0.05 |
| Solvent (Solv-9) | 0.10 |
| Sixth Layer (ultraviolet absorbing layer): | |
| Gelatin | 0.66 |
| Ultraviolet Absorbent (UV-1) | 0.19 |
| Ultraviolet Absorbent (UV-2) | 0.06 |
| Ultraviolet Absorbent (UV-3) | 0.06 |
| Ultraviolet Absorbent (UV-4) | 0.05 |
| Ultraviolet Absorbent (UV-5) | 0.09 |
| Solvent (Solv-7) | 0.25 |
| Seventh Layer (protective layer): | |
| Gelatin | 1.00 |
| Acryl-modified copolymer of polyvinyl alcohol (modification degree: 17%) | 0.04 |
| Liquid paraffin | 0.02 |
| Surface Active Agent (Cpd-13) | 0.01 |

Yellow Coupler (ExY)
A 60:40 (by mol) mixture of:
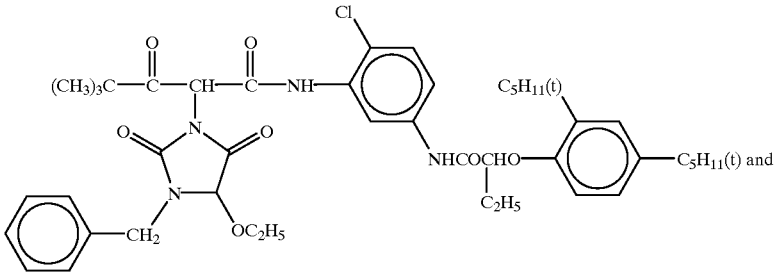
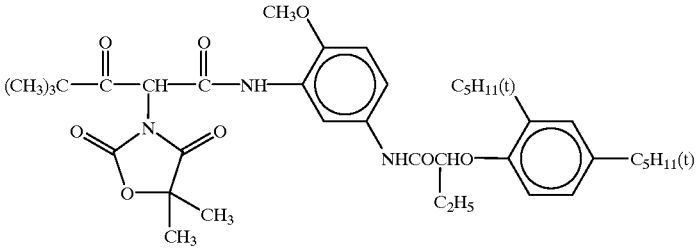
Magenta Coupler (ExM)
A 60:40 (by mol) mixture of
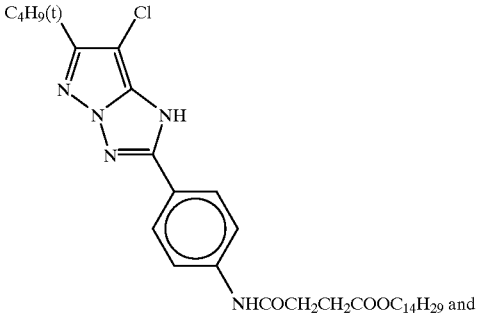
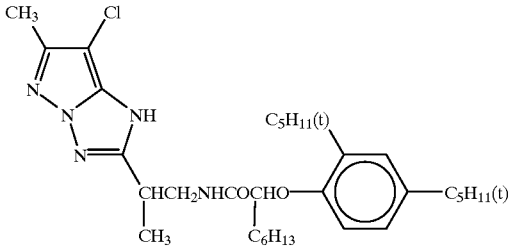
Cyan Coupler (ExC-1)
A 15:85 (by mol) mixture of
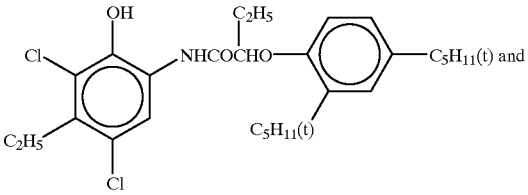
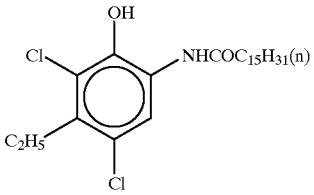
Cyan Coupler (ExC-2)
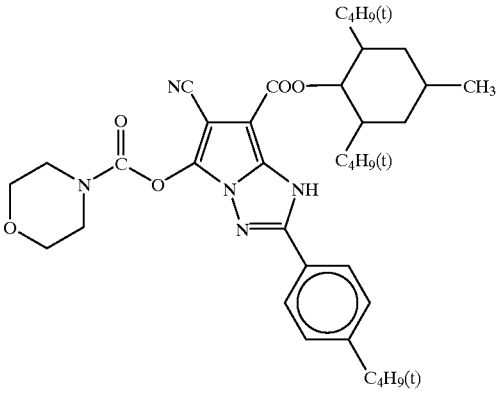

-continued
Cyan Coupler (ExC-3)
A 50:25:25 (by mol) mixture of
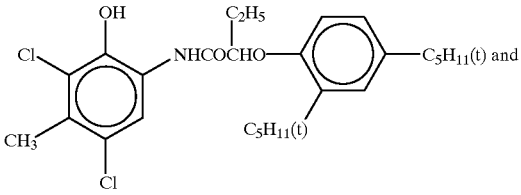
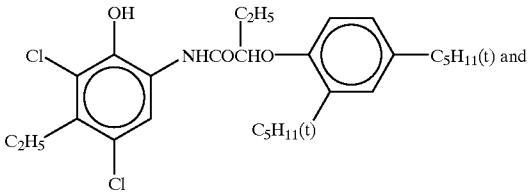
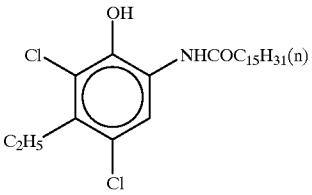
Dye Image Stabilizer (Cpd-1)
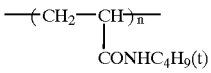
Number average molecular weight: 60,000
Dye Image Stabilizer (Cpd-2)
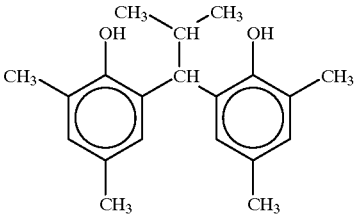
Dye Image Stabilizer (Cpd-3)
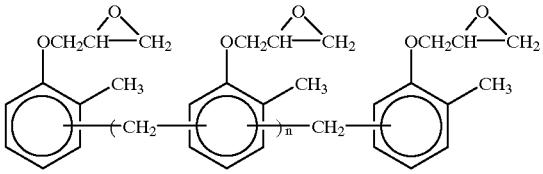
n: 7–8 (average)
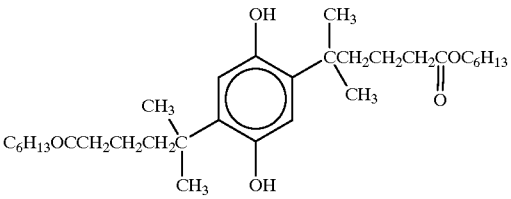
Color Mixing Inhibitor (Cpd-4)
A 1:1:1 (by mol) mixture of
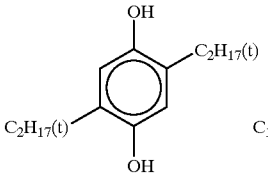
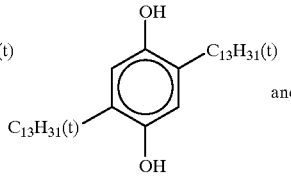
and
Color Mixing Inhibitory Aid (Cpd-5)
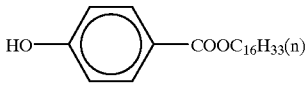
Stabilizer (Cpd-6)
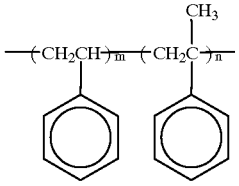
Number average molecular weight: 600
m/n = 10/90
Color Mixing Inhibitor (Cpd-7)
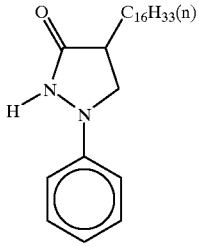

-continued
Dye Image Stabilizer (Cpd-8)
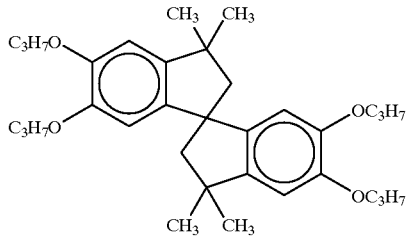
Dye Image Stabilizer (Cpd-9)
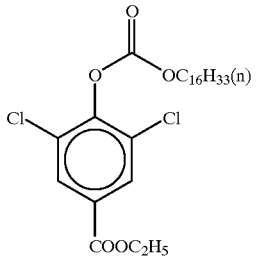
Dye Image Stabilizer (Cpd-10)
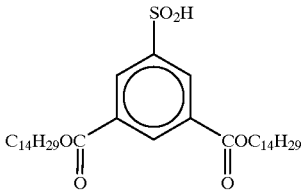
(Cpd-11)
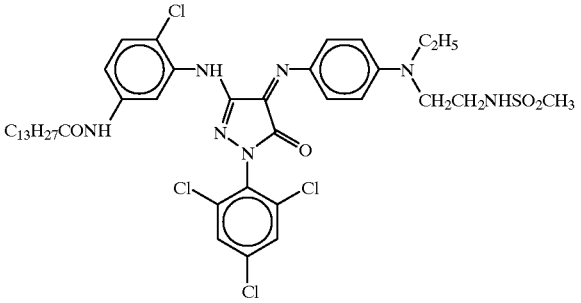
Dye Image Stabilizer (Cpd-12)
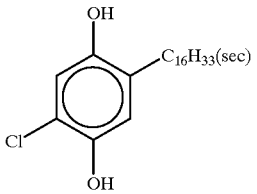
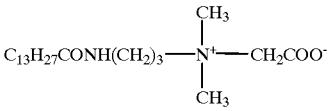
Surface Active Agent (Cpd-13)
A 7:3 (by mol) mixture of
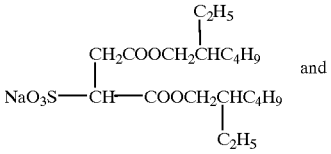
(Cpd-14)
of
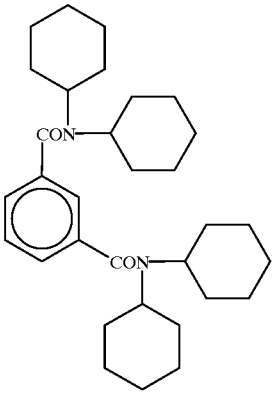
(Cpd-15)
A 1:1 (by mol) mixture
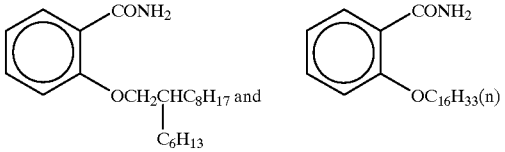
(Cpd-16)
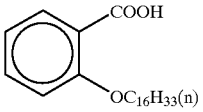
(Cpd-17)
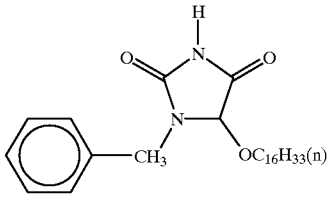

-continued
(Cpd-18)
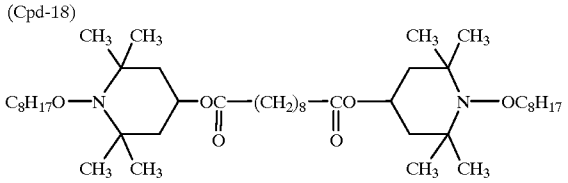
Dye Image Stabilizer (Cpd-19)
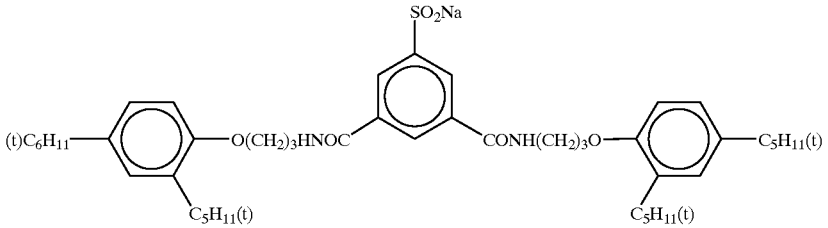
Dye Image Stabilizer (Cpd-20)
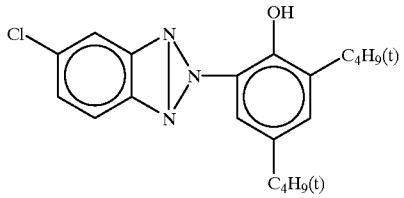
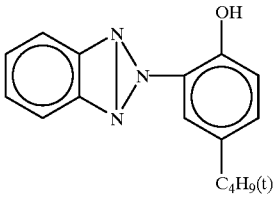
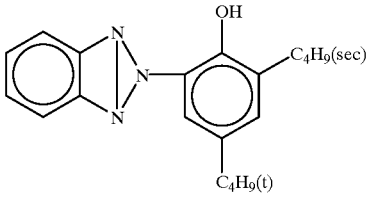
-continued
Ultraviolet Absorbent (UV-1)
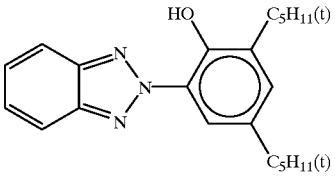
Ultraviolet Absorbent (UV-2)
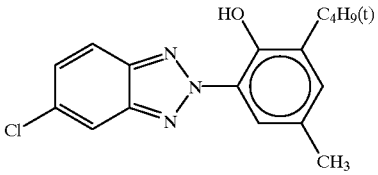
Ultraviolet Absorbent (UV-3)
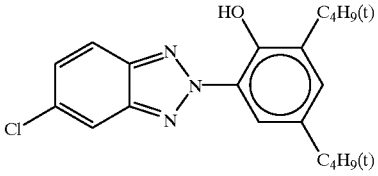
Ultraviolet Absorbent (UV-5)
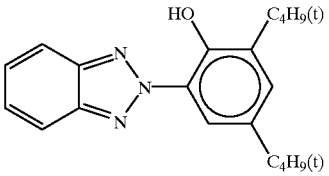
Ultraviolet Absorbent (UV-5)
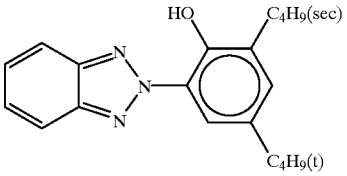
(Solv-1)
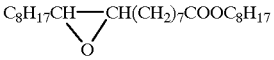

-continued (Solv-2)

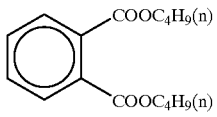

(Solv-3)

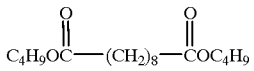

(Solv-4)

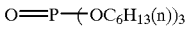

(Solv-5)

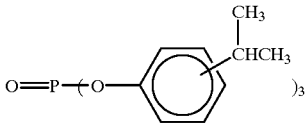

(Solv-6)

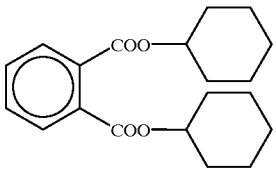

(Solv-7)

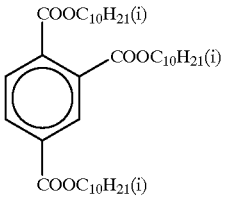

(Solv-8)

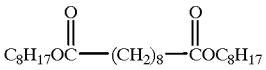

(Solv-9)

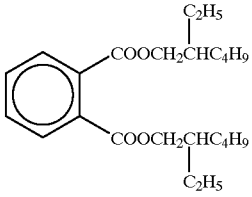

Further, Samples 202 to 212 were prepared by changing the emulsion of the fifth layer of Silver Halide Color Photographic Light-Sensitive Material 201 prepared above to Emulsions B to L of Example 1, respectively.

Using Samples 201 to 212 obtained, thoroughly the same test as in Example 1 was performed, as a result, similarly to the results in Example 1, in Samples 206, 207, 210, 211 and 212 of the present invention, an outstanding effect was obtained such that the high illuminance law failure was small and the change in sensitivity due to the time after exposure until processing was small.

EXAMPLE 3

Preparation of Emulsion TA

To a 2% aqueous solution of lime-processed gelatin, 1.0 g of sodium chloride was added and then an acid was added to adjust the pH to 4.5. To the resulting aqueous solution, an aqueous solution containing 0.05 mol of silver nitrate and an aqueous solution containing 0.05 mol in total of sodium chloride and potassium bromide were added and mixed at 40° C. while vigorously stirring. Subsequently, an aqueous solution containing 0.004 mol of potassium bromide was added and then and aqueous solution containing 0.13 mol of silver nitrate and an aqueous solution containing 0.13 mol of sodium chloride were added. After raising the temperature to 75° C., an aqueous solution containing 1.0 mol of silver nitrate and an aqueous solution containing 1.0 mol of sodium chloride were added and mixed while keeping the pAg at 7.0. Thereafter, the mixed solution was water washed by sedimentation at 40° C. to effect desalting. Thereafter, 100 g of lime-processed gelatin was added and the pH and the pAg were adjusted to 6.0 and 7.4, respectively.

To the thus-obtained emulsion, a gold sensitizer (chloroauric acid), a sulfur sensitizer (triethylthiourea), red-sensitive spectral sensitizing dyes (G and H) and Compound I were added to perform optimal chemical sensitization and spectral sensitization at 60° C. Further, after adding thereto 1-(5-methylureidophenyl)-5-mercaptotetrazole, a silver bromide-rich phase was formed in the same manner as in Emulsion A of Example 1. From the electron microphotograph, the grain was a tabular grain having {100} face as a major face and had a projected area corresponding diameter of 1.2 $\mu$m, an average aspect ratio of 5 and a coefficient of variation of 20%.

Preparation of Emulsions TB to TL

In the preparation of Emulsion TA, only the silver bromide-rich phase formation was replaced by the silver bromide-rich phase formation in the preparation of Examples B to L of Example 1, and the emulsions obtained were designated as Emulsions TB to TL, respectively.

Coated Samples 301 to 312 were prepared thoroughly in the same manner as in Example 1 using the emulsions prepared above and subjected to thoroughly the same test as in Example 1. As a result, it was known that by performing the silver bromide-rich phase formation of the present invention, the same effect as in Example 1 can be obtained also in the case of a tabular grain.

EXAMPLE 4

Samples 101 to 112, 201 to 212 and 301 to 312 were tested thoroughly in the same manner as in Example 1 except for changing the high-illuminance exposure for $10^{-6}$ second to the laser scanning exposure.

The laser light sources used were YAG solid laser (oscillation wavelength 946 nm) using a semiconductor laser GaAlAs (oscillation wavelength: 808.5 nm) as the excitation light source and taken out through wavelength conversion by the SHG crystal of $LiNbO_3$ having an inversion domain structure to have a wavelength of 473 nm, $YVO_4$ solid laser (oscillation wavelength: 1,064 nm) using a semiconductor laser GaAlAs (oscillation wavelength: 808.7 nm) as the excitation light source and taken out though wavelength conversion by the SHG crystal of $LiNbO_3$ having an inversion domain structure to have a wavelength of 532 nm, and AlGaInP (Type No. LN9R20, manufactured by Matsushita Densan, oscillation wavelength: about 680 nm). These three color laser beams each was moved in the direction perpendicular to the scanning direction by means of a polygon mirror so that the beams could expose by scanning the sample in sequence. The temperature was kept constant using the Peltier element and thereby the change in the quantity of light due to the temperature of the semiconductor laser was inhibited. The effective beam size was 80 $\mu$m, the scanning pitch was 42.3 $\mu$m (600 dpi) and the average exposure time was $1.7\times10^{-7}$ second per one pixel.

The results were completely the same as the results in Examples 1 to 3 and it was verified that in the samples of the present invention, the high-illuminance reciprocity law failure was small while successfully suppressing the change in sensitivity and change in gradation due to changing in the time after exposure until processing, and further the reduction in sensitivity on exposure at a high humidity was small.

According to the present invention, a silver halide emulsion improved in the high-illuminance reciprocity law failure on ultra short-time high-illuminance exposure as in the laser scanning exposure, reduced in the change in sensitivity and change in gradation due to changing in the time after exposure until processing and small in the reduction in sensitivity on exposure at a high humidity, a production process thereof, and a silver halide color photographic light-sensitive material and an image formation method using the emulsion, can be provided.

While the invention has been described in detail and with reference to specific embodiments thereof, it will be apparent to one skilled in the art that various changes and modifications can be made therein without departing from the spirit and scope thereof.

What is claimed is:

1. A silver halide emulsion which is a silver chlorobromide or silver chloroiodobromide emulsion having a silver chloride content of 90 mol % or more, wherein the silver halide grain in said emulsion has a silver bromide-rich phase which is an epitaxial deposit, the silver bromide-rich phase containing an iridium compound on a grain surface layer part, a grain edge part or a grain corner part and the silver bromide-rich phase comprises an outer region occupying from 1 to 99% by volume of the silver bromide-rich phase from the surface of the silver bromide-rich phase, and an inner region, wherein the inner region has a higher iridium compound density than the outer region has.

2. The silver halide emulsion as claimed in claim 1, wherein said silver halide grain is a cubic or tetradecahedral grain.

3. The silver halide emulsion as claimed in claim 1, wherein 50% or more of the entire projected area of all grains in said silver halide emulsion is occupied by tabular grains having {100} faces as major faces and having an average aspect ratio of 2 or more or tabular grains having {111} faces as major faces and having an average aspect ratio of 2 or more.

4. The silver halide emulsion as claimed in claim 1, wherein at least one compound selected from the group consisting of those represented by formulae (I), (II) and (III) is added and contained before the formation of the silver bromide-rich phase:

(I)

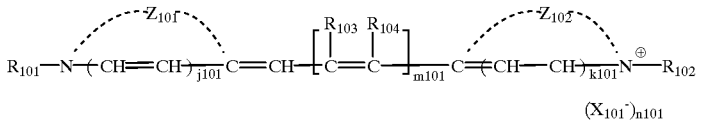

wherein $Z_{101}$ and $Z_{102}$ each represents an atomic group necessary for forming a nitrogen-containing heterocyclic nucleus; $R_{101}$ and $R_{102}$ each represents an alkyl group, an alkenyl group, an alkynyl group or an aralkyl group; $m_{101}$ represents 0 or a positive number of 1, 2 or 3; when $m_{101}$ is 1, $R_{103}$ represents a hydrogen atom, a lower alkyl group, an aralkyl group or an aryl group; $R_{104}$ represents a hydrogen atom; when $m_{101}$ is 2 or 3, $R_{103}$ represents a hydrogen atom and $R_{104}$ represents a hydrogen atom, a lower alkyl group or an aralkyl group or may be combined with $R_{102}$ to form a 5- or 6-membered ring; when $m_{101}$ represents 2 or 3 and $R_{104}$ represents a hydrogen atom, $R_{103}$ may be combined with another $R_{103}$ to form a hydrocarbon ring or a heterocyclic ring; $j_{101}$ and $k_{101}$ each represents 0 or 1; $X^-_{101}$ represents an acid anion; and $n_{101}$ represents 0 or 1, (II)

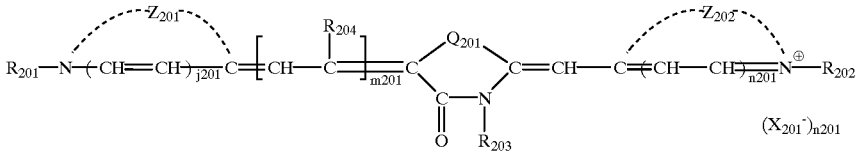

wherein $Z_{201}$ and $Z_{202}$ have the same meanings as $Z_{101}$ and $Z_{102}$ described above, respectively; $R_{201}$ and $R_{202}$ have the same meanings as $R_{101}$ and $R_{102}$ described above, respectively; $R_{203}$ represents an alkyl group, an alkenyl group, an alkynyl group or an aryl group; $m_{201}$ represents 0, 1 or 2; $R_{204}$ represents a hydrogen atom, a lower alkyl group or an aryl group; when $m_{201}$ represents 2, $R_{204}$ and $R_{204}$ may be combined to form a hydrocarbon ring or a heterocyclic ring; $Q_{201}$ represents a sulfur atom, an oxygen atom, a selenium atom or >N—$R_{205}$, and $R_{205}$ has the same meaning as $R_{203}$; and $j_{201}$, $R_{201}$, $X^-_{201}$ and $n_{201}$ have the same meanings as $j_{101}$, $k_{101}$, $X^-_{101}$ and $n_{101}$, respectively, (III)

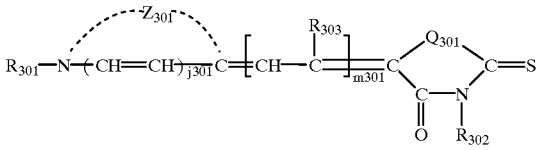

wherein $Z_{301}$ represents an atomic group necessary for forming a nitrogen-containing heterocyclic ring; $Q_{301}$ has the same meaning as $Q_{201}$; $R_{301}$ has the same meaning as $R_{101}$ or $R_{102}$; $R_{302}$ has the same meaning as $R_{203}$; $m_{301}$ has the same meaning as $m_{201}$; $R_{303}$ has the same meaning as $R_{204}$; when $m_{301}$ represents 2 or 3, $R_{303}$ may be combined with another $R_{303}$ to form a hydrocarbon ring or a heterocyclic ring; $j_{301}$ has the same meaning as $j_{101}$.

5. The silver halide emulsion as claimed in claim 1, wherein the silver bromide-rich phase is on the grain corner part.

6. A process for producing a silver halide emulsion which is a silver chlorobromide or silver chloroiodobromide emulsion having a silver chloride content of 90 mol % or more, which comprises forming a silver bromide-rich phase which is an epitaxial deposit, the silver bromide-rich phase containing an iridium compound on a grain surface layer part, a grain edge part or a grain corner part of a silver halide grain in the silver halide emulsion, wherein the formation process for forming said silver bromide-rich phase comprises at least two stages and the molar amount of an iridium compound added in one formation process based on the silver added is higher than the molar amount of an iridium compound added in any one of the formation processes subsequent thereto based on the silver added.

7. The process for producing a silver halide emulsion as claimed in claim 6, wherein the silver halide grain is a cubic or tetradecahedral grain.

8. The process for producing a silver halide emulsion as claimed in claim 6, wherein 50% or more of the entire projected area of all grains in said silver halide emulsion is occupied by tabular grains having {100} faces as major faces and having an average aspect ratio of 2 or more or tabular grains having {111} faces as major faces and having an average aspect ratio of 2 or more.

9. The process for producing a silver halide emulsion as claimed in claim 6, wherein at least one compound selected from the group consisting of those represented by formulae (I), (II) and (III) is added and contained before the formation of the silver bromide-rich phase:

(I)

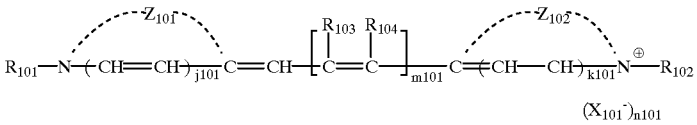

wherein $Z_{101}$ and $Z_{102}$ each represents an atomic group necessary for forming a nitrogen-containing heterocyclic nucleus; $R_{101}$ and $R_{102}$ each represents an alkyl group, an alkenyl group, an alkynyl group or an aralkyl group; $m_{101}$ represents 0 or a positive number of 1, 2 or 3; when $m_{101}$ is 1, $R_{103}$ represents a hydrogen atom, a lower alkyl group, an aralkyl group or an aryl group; $R_{104}$ represents a hydrogen atom; when $m_{101}$ is 2 or 3, $R_{103}$ represents a hydrogen atom and $R_{104}$ represents a hydrogen atom, a lower alkyl group or an aralkyl group or may be combined with $R_{102}$ to form a 5- or 6-membered ring; when $m_{101}$ represents 2 or 3 and $R_{104}$ represents a hydrogen atom, $R_{103}$ may be combined with another $R_{103}$ to form a hydrocarbon ring or a heterocyclic ring; $j_{101}$ and $k_{101}$ each represents 0 or 1; $X^-_{101}$ represents an acid anion; and $n_{101}$ represents 0 or 1, (II)

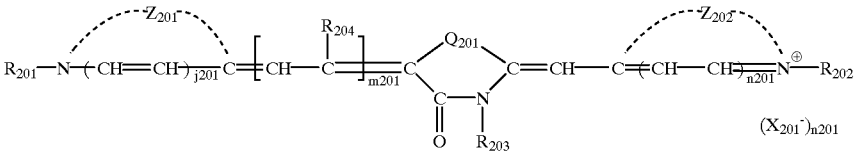

wherein $Z_{201}$ and $Z_{202}$ have the same meanings as $Z_{101}$ and $Z_{102}$ described above, respectively; $R_{201}$ and $R_{202}$ have the same meanings as $R_{101}$ and $R_{102}$ described above, respectively; $R_{203}$ represents an alkyl group, an alkenyl group, an alkynyl group or an aryl group; $m_{201}$ represents 0, 1 or 2; $R_{204}$ represents a hydrogen atom, a lower alkyl group or an aryl group; when $m_{201}$ represents 2, $R_{204}$ and $R_{204}$ may be combined to form a hydrocarbon ring or a heterocyclic ring; $Q_{201}$ represents a sulfur atom, an oxygen atom, a selenium atom or >N—$R_{205}$, and $R_{205}$ has the same meaning as $R_{203}$; and $j_{201}$, $R_{201}$, $X^-_{201}$ and $n_{201}$ have the same meanings as $j_{101}$, $k_{101}$, $X^-_{101}$ and $n_{101}$, respectively, (III)

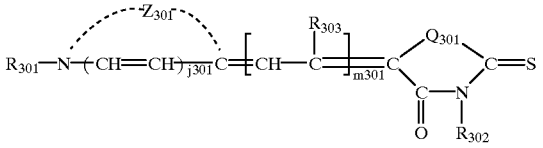

wherein $Z_{301}$ represents an atomic group necessary for forming a nitrogen-containing heterocyclic ring; $Q_{301}$ has the same meaning as $Q_{201}$; $R_{301}$ has the same meaning as $R_{101}$ or $R_{102}$; $R_{302}$ has the same meaning as $R_{203}$; $m_{301}$ has the same meaning as $m_{201}$; $R_{303}$ has the same meaning as $R_{204}$; when $m_{301}$ represents 2 or 3, $R_{303}$ may be combined with another $R_{303}$ to form a hydrocarbon ring or a heterocyclic ring; $j_{301}$ has the same meaning as $j_{101}$.

10. The process for producing a silver halide emulsion as claimed in claim 6, wherein said silver bromide-rich phase is formed by adding at least twice a silver bromide fine grain emulsion or silver chlorobromide fine grain emulsion having a grain size smaller than that of a silver halide emulsion comprising a silver chlorobromide or silver chloroiodobromide host grains.

11. The process for producing a silver halide emulsion as claimed in claim 6, wherein the silver bromide-rich phase is on the grain corner part.

12. A silver halide color photographic light-sensitive material comprising a support having thereon at least one blue-sensitive silver halide emulsion layer, at least one green-sensitive silver halide emulsion layer and at least one red-sensitive silver halide emulsion layer, wherein at least one of said blue-sensitive silver halide emulsion layer, green-sensitive silver halide emulsion layer and red-sensitive silver halide emulsion layer contains a silver chlorobromide or silver chloroiodobromide emulsion having a silver chloride content of 90 mol % or more, wherein the silver halide grain in said emulsion has a silver bromide-rich phase which is an epitaxial deposit, the silver bromide-rich phase containing an iridium compound on a grain surface layer part, a grain edge part or a grain corner part and the silver bromide-rich phase comprises an outer region occupying from 1 to 99% by volume of the silver bromide-rich phase from the surface of the silver bromide-rich phase, and an inner region, wherein the inner region has a higher iridium compound density than the outer region has.

13. The silver halide color photographic light-sensitive material as claimed in claim 12, wherein the silver halide grain is a cubic or tetradecahedral grain.

14. The silver halide color photographic light-sensitive material as claimed in claim 12, wherein 50% or more of the entire projected area of all grains in said silver halide emulsion is occupied by tabular grains having {100} faces as major faces and having an average aspect ratio of 2 or more or tabular grains having {111} faces as major faces and having an average aspect ratio of 2 or more.

15. The silver halide color photographic light-sensitive material as claimed in claim 12, wherein at least one compound selected from the group consisting of those represented by formulae (I), (II) and (III) is added and contained before the formation of the silver bromide-rich phase:

(I)

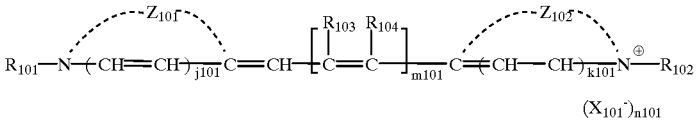

wherein $Z_{101}$ and $Z_{102}$ each represents an atomic group necessary for forming a nitrogen-containing heterocyclic nucleus; $R_{101}$ and $R_{102}$ each represents an alkyl group, an alkenyl group, an alkynyl group or an aralkyl group; $m_{101}$ represents 0 or a positive number of 1, 2 or 3; when $m_{101}$ is 1, $R_{103}$ represents a hydrogen atom, a lower alkyl group, an aralkyl group or an aryl group; $R_{104}$ represents a hydrogen atom; when $m_{101}$ is 2 or 3, $R_{103}$ represents a hydrogen atom and $R_{104}$ represents a hydrogen atom, a lower alkyl group or an aralkyl group or may be combined with $R_{102}$ to form a 5- or 6-membered ring; when $m_{101}$ represents 2 or 3 and $R_{104}$ represents a hydrogen atom, $R_{103}$ may be combined with another $R_{103}$ to form a hydrocarbon ring or a heterocyclic ring; $j_{101}$ and $k_{101}$ each represents 0 or 1; $X^-_{101}$ represents an acid anion; and $n_{101}$ represents 0 or 1, (II)

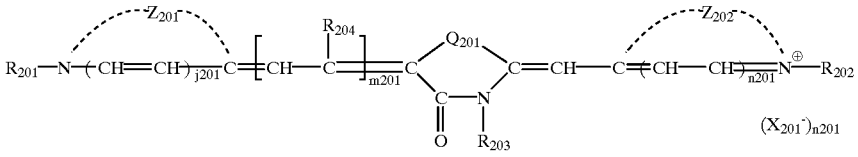

wherein $Z_{201}$ and $Z_{202}$ have the same meanings as $Z_{101}$ and $Z_{102}$ described above, respectively; $R_{201}$ and $R_{202}$ have the same meanings as $R_{101}$ and $R_{102}$ described above, respectively; $R_{203}$ represents an alkyl group, an alkenyl group, an alkynyl group or an aryl group; $m_{201}$ represents 0, 1 or 2; $R_{204}$ represents a hydrogen atom, a lower alkyl group or an aryl group; when $m_{201}$ represents 2, $R_{204}$ and $R_{204}$ may be combined to form a hydrocarbon ring or a heterocyclic ring; $Q_{201}$ represents a sulfur atom, an oxygen atom, a selenium atom or >N—$R_{205}$, and $R_{205}$ has the same meaning as $R_{203}$; and $j_{201}$, $R_{201}$, $X^-_{201}$ and $n_{201}$ have the same meanings as $j_{101}$, $k_{101}$, $X^-_{101}$, and $n_{101}$, respectively, (III)

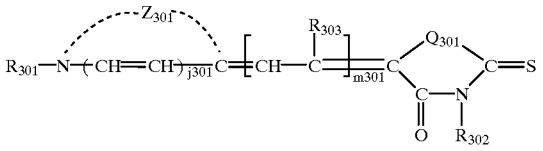

wherein $Z_{301}$ represents an atomic group necessary for forming a nitrogen-containing heterocyclic ring; $Q_{301}$ has the same meaning as $Q_{201}$; $R_{301}$ has the same meaning as $R_{101}$ or $R_{102}$; $R_{302}$ has the same meaning as $R_{203}$; $m_{301}$ has the same meaning as $m_{201}$; $R_{303}$ has the same meaning as $R_{204}$; when $m_{301}$ represents 2 or 3, $R_{303}$ may be combined with another $R_{303}$ to form a hydrocarbon ring or a heterocyclic ring; $j_{301}$ has the same meaning as $j_{101}$.

16. The silver halide color photographic light-sensitive material as claimed in claim 12, wherein the silver bromide-rich phase is on the grain corner part.

17. A silver halide color photographic light-sensitive material comprising a support having thereon at least one blue-sensitive silver halide emulsion layer, at least one green-sensitive silver halide emulsion layer and at least one red-sensitive silver halide emulsion layer, wherein at least one of said blue-sensitive silver halide emulsion layer, green-sensitive silver halide emulsion layer and red-sensitive silver halide emulsion layer contains a silver chlorobromide or silver chloroiodobromide emulsion having a silver chloride content of 90 mol % or more, wherein the silver halide grain in said emulsion has a silver bromide-rich phase which is an epitaxial deposit, the silver bromide-rich phase containing an iridium compound on a grain surface layer part, a grain edge part or a grain corner part, wherein the silver halide emulsion is obtained by the formation process for forming said silver bromide-rich phase which comprises at least two stages and the molar amount of an iridium compound added in one formation process based on the silver added is higher than the molar amount of an iridium compound added in any one of the formation processes subsequent thereto based on the silver added.

18. The silver halide color photographic light-sensitive material as claimed in claim 17, wherein the silver halide grain is a cubic or tetradecahedral grain.

19. The silver halide color photographic light-sensitive material as claimed in claim 17, wherein 50% or more of the entire projected area of all grains in said silver halide emulsion is occupied by tabular grains having {100} faces as major faces and having an average aspect ratio of 2 or more or tabular grains having {111} faces as major faces and having an average aspect ratio of 2 or more.

20. The silver halide color photographic light-sensitive material as claimed in claim 17, wherein at least one compound selected from the group consisting of those represented by formulae (I), (II) and (III) is added and contained before the formation of the silver bromide-rich phase:

(I)

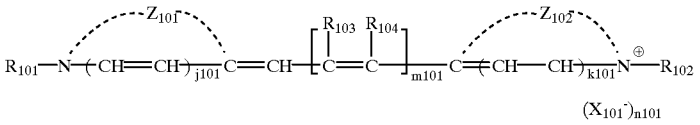

wherein $Z_{101}$ and $Z_{102}$ each represents an atomic group necessary for forming a nitrogen-containing heterocyclic nucleus; $R_{101}$ and $R_{102}$ each represents an alkyl group, an alkenyl group, an alkynyl group or an aralkyl group; $m_{101}$ represents 0 or a positive number of 1, 2 or 3; when $m_{101}$ is 1, $R_{103}$ represents a hydrogen atom, a lower alkyl group, an aralkyl group or an aryl group; $R_{104}$ represents a hydrogen atom; when $m_{101}$ is 2 or 3, $R_{103}$ represents a hydrogen atom and $R_{104}$ represents a hydrogen atom, a lower alkyl group or an aralkyl group or may be combined with $R_{102}$ to form a 5- or 6-membered ring; when $m_{101}$ represents 2 or 3 and $R_{104}$ represents a hydrogen atom, $R_{103}$ may be combined with another $R_{103}$ to form a hydrocarbon ring or a heterocyclic ring; $j_{101}$ and $k_{101}$ each represents 0 or 1; $X^-_{101}$ represents an acid anion; and $n_{101}$ represents 0 or 1, (II)

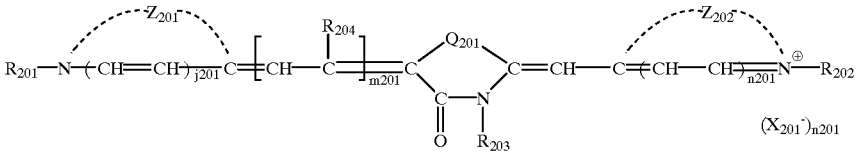

wherein $Z_{201}$ and $Z_{202}$ have the same meanings as $Z_{101}$ and $Z_{102}$ described above, respectively; $R_{201}$ and $R_{202}$ have the same meanings as $R_{101}$ and $R_{102}$ described above, respectively; $R_{203}$ represents an alkyl group, an alkenyl group, an alkynyl group or an aryl group; $m_{201}$ represents 0, 1 or 2; $R_{204}$ represents a hydrogen atom, a lower alkyl group or an aryl group; when $m_{201}$ represents 2, $R_{204}$ and $R_{204}$ may be combined to form a hydrocarbon ring or a heterocyclic ring; $Q_{201}$ represents a sulfur atom, an oxygen atom, a selenium atom or >N—$R_{205}$, and $R_{205}$ has the same meaning as $R_{203}$; and $j_{201}$, $R_{201}$, $X^-_{201}$ and $n_{201}$ ; have the same meanings as $j_{101}$, $k_{101}$, $X^-_{101}$, and $n_{101}$, respectively, (III)

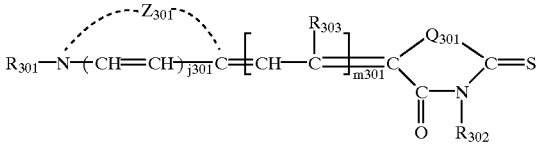

wherein $Z_{301}$ represents an atomic group necessary for forming a nitrogen-containing heterocyclic ring; $Q_{301}$ has the same meaning as $Q_{201}$; $R_{301}$ has the same meaning as $R_{101}$ or $R_{102}$; $R_{302}$ has the same meaning as $R_{203}$; $m_{301}$ has the same meaning as $m_{201}$; $R_{303}$ has the same meaning as $R_{204}$; when $m_{301}$ represents 3 or 3, $R_{303}$ may be combined with another $R_{303}$ to form a hydrocarbon ring or a heterocyclic ring; $j_{301}$ has the same meaning as $j_{101}$.

21. A method for forming an image, which comprises exposing by scanning the silver halide color photographic light-sensitive material described in claim 12 with a laser bean modulated based on the image information for an exposure time of less than $10^{-4}$ second per one pixel.

22. A method for forming an image, which comprises exposing by scanning the silver halide color photographic light-sensitive material described in claim 17 with a laser beam modulated based on the image information for an exposure time of less than $10^{-4}$ second per one pixel.

23. The silver halide color photographic light-sensitive material as claimed in claim 20, wherein the silver bromide-rich phase is on the grain corner part.

* * * * *